US012649553B2

(12) United States Patent
Rosa et al.

(10) Patent No.: US 12,649,553 B2
(45) Date of Patent: Jun. 9, 2026

(54) CLOUD ASSISTED UNDERWATER VEHICLE CONTROL

(71) Applicant: Apeiron Labs Inc., Cambridge, MA (US)

(72) Inventors: Kevin Rosa, Somerville, MA (US); Michael Hunter, Lehi, UT (US); Justin Marple, Malden, MA (US); Will O'Halloran, Boston, MA (US); Ravi Pappu, Newton, MA (US)

(73) Assignee: Apeiron Labs Inc., Cambridge, MA (US)

( * ) Notice: Subject to any disclaimer, the term of this patent is extended or adjusted under 35 U.S.C. 154(b) by 100 days.

(21) Appl. No.: 18/741,453

(22) Filed: Jun. 12, 2024

(65) Prior Publication Data

US 2025/0382041 A1 Dec. 18, 2025

(51) Int. Cl.
*B63G 8/00* (2006.01)
*B63B 79/20* (2020.01)
(Continued)

(52) U.S. Cl.
CPC ..... *B63G 8/001* (2013.01); *B63B 79/20* (2020.01); *B63B 79/30* (2020.01); *B63B 79/40* (2020.01);
(Continued)

(58) Field of Classification Search
CPC .... B63G 8/001; B63G 8/14; B63G 2008/005; B63B 79/20; B63B 79/30; B63B 79/40
See application file for complete search history.

(56) References Cited

U.S. PATENT DOCUMENTS 10,545,253 B2 * 1/2020 Brizard ..... G05D 1/10
10,908,250 B1 * 2/2021 Dudinsky ..... B63G 8/001
(Continued)

FOREIGN PATENT DOCUMENTS

CN 113879495 A * 1/2022 ..... G06F 30/15
CN 114655398 A * 6/2022 ..... B63G 8/14

OTHER PUBLICATIONS

Machine translation of CN114655398 (Year: 2022).*
(Continued)

*Primary Examiner* — Anne Marie Antonucci
*Assistant Examiner* — Patrick Daniel Mohl
(74) *Attorney, Agent, or Firm* — Foley & Lardner LLP

(57) ABSTRACT

Cloud assisted underwater vehicle control is provided. A system can include one or more processors that can receive, via a communications network from an underwater vehicle in an aqueous medium and remote from the one or more processors, an indication of a location of the underwater vehicle. The one or more processors can predict, using the location of the underwater vehicle and a model constructed with at least one of historical ocean current data for the location or data associated with maritime topography of the location, movement of the underwater vehicle through the aqueous medium. The one or more processors can generate, according to the predicted movement, at least one control decision. The one or more processors can transmit, via the communications network to the underwater vehicle, the at least one control decision to cause the underwater vehicle to submerge in the aqueous medium.

20 Claims, 11 Drawing Sheets

(51) Int. Cl.

| | |
|---|---|
| ***B63B 79/30*** | (2020.01) |
| ***B63B 79/40*** | (2020.01) |
| ***B63G 8/14*** | (2006.01) |

(52) U.S. Cl.
CPC ..... *B63G 8/14* (2013.01); *B63G 2008/005* (2013.01)

(56) References Cited

U.S. PATENT DOCUMENTS

| | | | | |
|---|---|---|---|---|
| 2013/0032078 | A1* | 2/2013 | Yahnker | B63G 8/18 114/331 |
| 2017/0242144 | A1* | 8/2017 | Brizard | B63G 8/001 |
| 2019/0202537 | A1* | 7/2019 | Easterling | B63C 11/26 |
| 2021/0001965 | A1* | 1/2021 | Heinen | B63G 8/22 |
| 2022/0363357 | A1* | 11/2022 | Strunk | B63G 8/001 |
| 2022/0390948 | A1* | 12/2022 | Julian | H04W 4/40 |
| 2024/0272644 | A1* | 8/2024 | Clabburn | G05D 1/0206 |
| 2025/0074558 | A1* | 3/2025 | Roenigk | B63B 79/40 |

OTHER PUBLICATIONS

Machine translation of CN113879495 (Year: 2022).*

Branch, A. et al., "Station Keeping with an Autonomous Underwater Glider Using a Predictive Model of Ocean Currents," Proc. AI in the Oceans and Space Workshop, International Joint Conference on Artificial Intelligence, Melbourne, Australia, Aug. 2017 (5 pages).

Clark, E. et al., "Station-Keeping Underwater Gliders Using a Predictive Ocean Circulation Model and Applications to SWOT Calibration and Validation," IEEE Journal of Oceanic Engineering (2020).

Forget, G., "Digital Twins for Ocean Robots," JuliaCon2023, MIT Jul. 26, 2023, URL: https://www.youtube.com/watch?app=desktop&v=VWsQmS59_yw&list=PLP8iPy9hna6T7PRe2sucSonFsrrH-oEZC&index=81.

Trotta, F. et al., "A Relocatable Ocean Modeling Platform for Downscaling to Shelf-Coastal Areas to Support Disaster Risk Reduction," Frontiers in Marine Science, vol. 8, Mar. 2021 (22 pages).

Xarray, "N-D Labeled Arrays and Datasets in Python," 12 pages, URL: https://xarray.dev/ (2024) [Site Accessed: May 10, 2024].

* cited by examiner

CLOUD ASSISTED UNDERWATER VEHICLE CONTROL

BACKGROUND

A vehicle can be submerged in an aqueous medium, such as the sea. However, it can be challenging to navigate the submerged vehicle without utilizing excessive energy resources or using advanced sensors.

SUMMARY

Technical solutions described herein are directed to cloud assisted underwater vehicle (e.g., a glider) control. A system can include a computing system located remote from the glider (e.g., a cloud platform, a cloud server, a remote server, etc.). The computing system can receive ocean current forecasts from at least one data source. The computing system can apply ocean physics modeling to downscale the ocean current forecasts, and produce a current forecast with high resolution, e.g., 100 meter resolution or less. For example, downscaling can refer to or include increasing the resolution of the current forecast or inferring a higher-resolution current forecast from a lower resolution current forecast. The computing system can use a digital twin of a glider that indicates nominal or a-priori performance of the glider in diving and surfacing to simulate movements of the glider through the ocean according to the predicted ocean currents. With the simulated movements of the glider, the computing system can determine various commands to operate the glider. The commands can be optimized to reduce energy consumption of the glider, increase accuracy between intended glider positions and actual glider positions, reduce distance traveled by the glider, etc. The commands can be optimized to select a heading, dive angle, surfacing angle, or variable dwell time at a particular depth. Responsive to the glider surfacing, the computing system can determine at least one command to navigate the glider based on the simulations, and can transmit the command to the glider. The glider can autonomously navigate according to the command.

At least one aspect of the present disclosure is directed to a system. The system can include one or more processors to receive, via a communications network from an underwater vehicle in an aqueous medium and remote from the one or more processors, an indication of a location of the underwater vehicle. The one or more processors can predict (e.g., generate a prediction/estimation of), using the location of the underwater vehicle and a model constructed with at least one of historical ocean current data for the location or data associated with maritime topography of the location, movement of the underwater vehicle through the aqueous medium. The one or more processors can generate, according to the predicted movement, at least one control decision including a depth in the aqueous medium, a duration to submerge in the aqueous medium, and a heading of the underwater vehicle. The one or more processors can transmit, via the communications network to the underwater vehicle, the at least one control decision to cause the underwater vehicle to submerge in the aqueous medium in accordance with the at least one control decision.

In some implementations, the one or more processors can determine, while the underwater vehicle is submerged, a simulated location of the underwater vehicle at a time stamp subsequent to the duration and responsive to the at least one control decision. The one or more processors can receive, via the communications network responsive to the underwater vehicle surfacing subsequent to the duration, a second location of the underwater vehicle. The one or more processors can predict, using the model, the simulated location and the second location, a second movement of the underwater vehicle through the aqueous medium. The one or more processors can generate, according to the second predicted movement, at least one second control decision including a second depth, a second duration, and a second heading. The one or more processors can transmit, via the communications network to the underwater vehicle, at least one second control decision to cause the underwater vehicle to submerge in the aqueous medium in accordance with the at least one second control decision.

The one or more processors can receive, via the communications network responsive to the underwater vehicle surfacing subsequent to submerging in accordance with the at least one control decision, a second location of the underwater vehicle. The one or more processors can update the model according to the second location of the underwater vehicle.

The one or more processors can predict, using the updated model, second movement of the underwater vehicle through the aqueous medium. The one or more processors can generate at least one second control decision according to the predicted second movement. The one or more processors can transmit, via the communications network to the underwater vehicle, the at least one second control decision.

The one or more processors can generate, using a forecasted map of currents of the aqueous medium, a downscaled map that indicates downscaled currents of the aqueous medium. The one or more processors can predict the movement using the downscaled map.

In some implementations, the underwater vehicle determines the location responsive to surfacing and according to a signal from a global positioning system.

The one or more processors can identify a mode of the underwater vehicle, wherein the mode includes at least one of station keeping or navigation to a waypoint. The one or more processors can generate the at least one control decision according to the mode of the underwater vehicle.

The one or more processors can receive locations from gliders, the gliders including the underwater vehicle. The one or more processors can generate the at least one control decision for the underwater vehicle based at least in part on the locations to cause the underwater vehicle to maintain a predetermined distance relative to at least one of the gliders in the aqueous medium.

The one or more processors can receive, via the communications network, locations from gliders, the gliders including the underwater vehicle. The one or more processors can predict, using the locations, movements of the gliders through the aqueous medium. The one or more processors can generate, according to the predicted movements, control decisions including a respective depth, a respective duration and a respective heading. The one or more processors can transmit, via the communications network to the gliders, the control decisions to cause the gliders to submerge in the aqueous medium in accordance with the control decisions.

The one or more processors can execute an optimization function on the predicted movements to determine the control decisions that reduce distances traveled by the gliders.

The one or more processors can provide, for display via a graphical user interface, a simulation including the predicted movement of the underwater vehicle and a second predicted movement of the underwater vehicle in accordance with the at least one control decision.

In some implementations, the underwater vehicle includes a buoyancy engine disposed within a fuselage of the underwater vehicle, the buoyancy engine configured to adjust a buoyancy and a center-of-gravity of the underwater vehicle in the aqueous medium to cause the underwater vehicle to submerge in the aqueous medium in accordance with the at least one control decision.

The one or more processors can receive, via the communications network from the underwater vehicle subsequent to the underwater vehicle submerging responsive to the at least one control decision, a second location from the underwater vehicle, wherein the underwater vehicle surfaces to provide the second location responsive to detection of an event and at a time stamp that is less than the duration. The one or more processors can receive data collected by a sensor of the underwater vehicle.

The one or more processors can generate the at least one control decision including data collection instructions. The one or more processors can transmit the at least one control decision to the underwater vehicle to cause the underwater vehicle to execute the data collection instructions.

At least one aspect of the present disclosure is directed to a method. The method can include receiving, by one or more processors, via a communication network from an underwater vehicle in an aqueous medium and remote from the one or more processors, an indication of a location of the underwater vehicle. The method can include predicting, by the one or more processors, using the location of the underwater vehicle and a model constructed with at least one of historical ocean current data for the location or data associated with maritime topography of the location, movement of the underwater vehicle through the aqueous medium. The method can include generating, by the one or more processors, according to the predicted movement, at least one control decision including a depth in the aqueous medium, a duration to submerge in the aqueous medium, and a heading of the underwater vehicle. The method can include transmitting, by the one or more processors to the underwater vehicle, the at least one control decision to cause the underwater vehicle to submerge in the aqueous medium in accordance with the at least one control decision.

The method can include determining, by the one or more processors via the communication network, while the underwater vehicle is submerged, a simulated location of the underwater vehicle at a time stamp subsequent to the duration and responsive to the at least one control decision. The method can include receiving, by the one or more processors via the communication network, responsive to the underwater vehicle surfacing subsequent to the duration, a second location of the underwater vehicle. The method can include predicting, by the one or more processors using the model, the simulated location and the second location, a second movement of the underwater vehicle through the aqueous medium. The method can include generating, by the one or more processors and according to the second predicted movement, at least one second control decision including a second depth, a second duration, and a second heading. The method can include transmitting, by the one or more processors via the communication network to the underwater vehicle, the at least one second control decision to cause the underwater vehicle to submerge in the aqueous medium in accordance with the at least one second control decision.

The method can include receiving, by the one or more processors via the communication network, responsive to the underwater vehicle surfacing subsequent to submerging in accordance with the at least one control decision, a second location of the underwater vehicle. The method can include updating, by the one or more processors, the model according to the second location of the underwater vehicle.

The method can include predicting, by the one or more processors using the updated model, second movement of the underwater vehicle through the aqueous medium. The method can include generating, by the one or more processors, at least one second control decision according to the predicted second movement. The method can include transmitting, by the one or more processors via the communication network to the underwater vehicle, the at least one second control decision.

At least one aspect of the present disclosure is directed to an underwater vehicle. The vehicle can include a buoyancy engine disposed within a fuselage of the underwater vehicle, the buoyancy engine configured to adjust a buoyancy and a center-of-gravity of the underwater vehicle in the aqueous medium to cause the underwater vehicle to submerge in the aqueous medium. The vehicle can include a location sensor. The vehicle can include one or more processors to transmit, via a communication network to a data processing system remote from the underwater vehicle, an indication of a location of the underwater vehicle detected via the location sensor. The one or more processors can receive, via the communication network from the data processing system, at least one control decision generated according to a predicted movement of the underwater vehicle predicted by the data processing system using the location of the underwater vehicle and a model constructed with at least one of historical ocean current data for the location or maritime topography of the location. The one or more processors can cause the buoyancy engine to submerge the underwater vehicle in the aqueous medium in accordance with the at least one control decision.

The one or more processors can detect, via a sensor of the underwater vehicle, a condition. The one or more processors can cause, responsive to the condition, the underwater vehicle to surface prior to expiration of a duration established in the at least one control decision. The one or more processors can transmit, via the communication network upon surfacing, a second location and data associated with the condition to the data processing system remote from the underwater vehicle.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification. The foregoing information and the following detailed description and drawings include illustrative examples and should not be considered as limiting.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
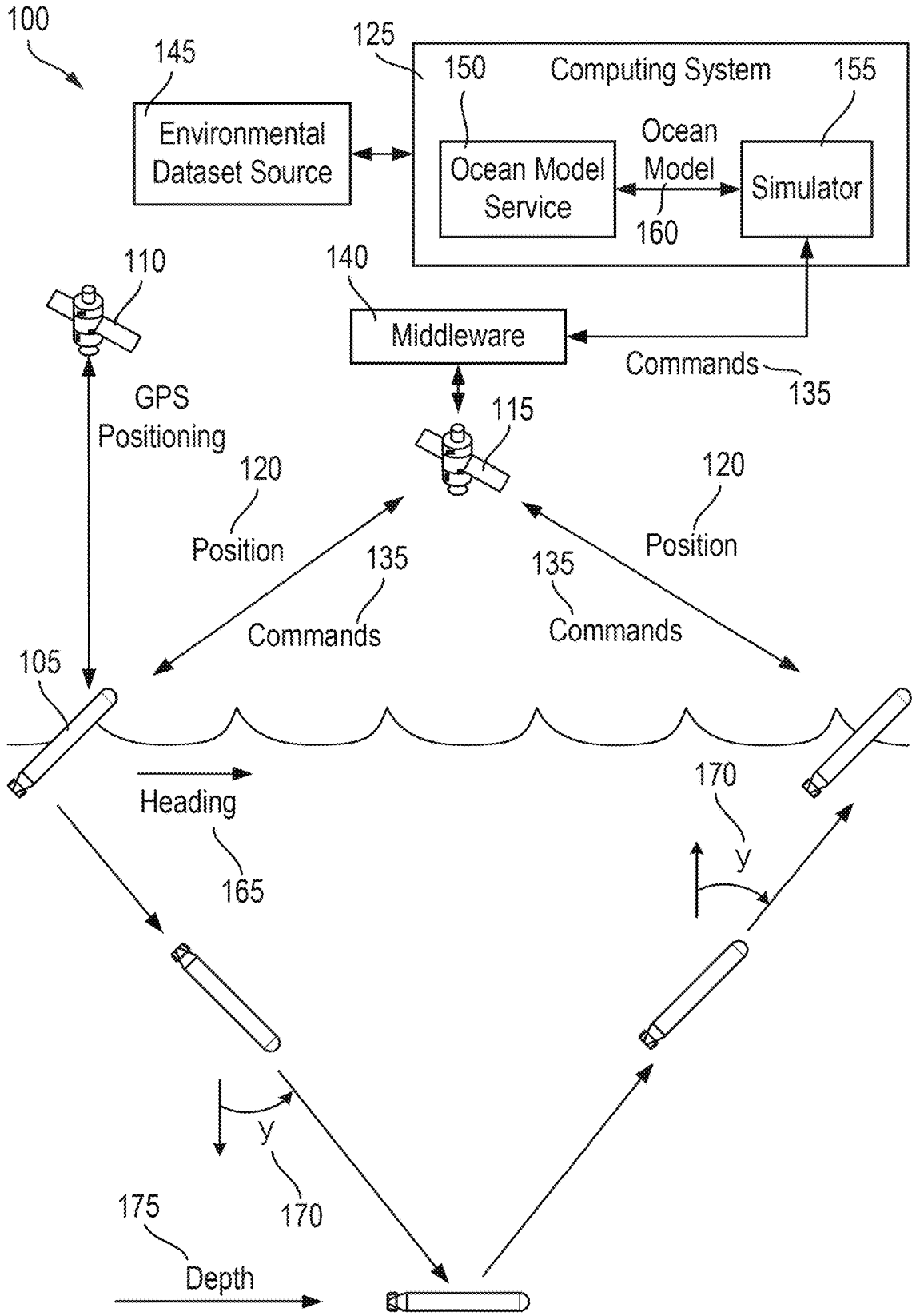
FIG. 1 is an example system to control an underwater vehicle from the cloud.

Following below are more detailed descriptions of various concepts related to, and implementations of, methods, apparatuses, and systems of cloud assisted underwater vehicle control. The various concepts introduced above and discussed in greater detail below may be implemented in any of numerous ways.

A glider (e.g., submersible glider) can be a platform that submerges in, and travels through, an aqueous medium. The glider can include an underwater vehicle of any type or form. The aqueous medium can be water, oil, or any other liquid. The aqueous medium can be an ocean, a sea, a lake, a flooded area, a canal, or any other body of liquid. The glider can derive its horizontal mobility or gliding propulsion from an imbalance between the buoyancy of the glider and the weight of the glider. The glider can move via "sorties" where the glider submerges, glides forward and downward to a particular depth at a particular dive angle and heading, and then rises up to the surface at a particular angle and heading to surface again.

However, the glider may need a navigation system, such as an inertial navigation system (INS), to navigate when the glider is submerged. While submerged, other navigation sources such as GPS may be unavailable, and therefore an INS may be used to track location the glider's position while submerged. However, an INS can increase the size and weight of the glider. The INS itself, and the increased glider weight, can cause the glider to consume additional battery power of the glider. This can reduce the maximum distance or range the glider can travel between charges, and can reduce the length of time a glider can be deployed before needed to be collected, re-charged, or re-fueled. Furthermore, INS systems can have unbounded compounding errors that may need to be periodically reset, thus reducing the accuracy of INS based glider navigation.

In some implementations, the glider can include a computing system that can perform fully autonomous navigation decisions for the glider. However, due to the complexity of predicting ocean currents, the glider computing system may need to be large, consuming excessive computing resources, memory resources, or power. Furthermore, for a collection of gliders, each glider may execute similar navigation computations, such as simulating the same ocean currents, and thus many computations executed by the gliders may be duplicative. The fleet or collection of gliders further may not be accurately controlled, and therefore, the data collected by the gliders can vary in spatial and temporal coordinates, instead of being collected at desired spatial or temporal coordinates.

To solve for these, and other technical issues, the technical solutions disclosed herein can include cloud assisted underwater glider control. A system can include a computing system located remote from the gliders (e.g., a cloud platform, a cloud server, a remote server, etc.). The computing system can receive ocean current forecasts from at least one data source. The computing system can apply ocean physics modeling to downscale the ocean current forecasts, and produce a current forecast with high resolution, e.g., 100 meter resolution or less. The resulting current forecast can be a 4-dimensional data structure indicating predicted currents at various longitudes, latitudes, depths, and times. The computing system can, with the current forecast, predict the movements of the glider in the aqueous medium. The computing system can store a digital twin representing characteristics of the glider. The digital twin can indicate nominal or a-priori performance of the glider in diving and surfacing. For example, the digital twin can indicate horizontal or vertical velocity of the glider at a variety of dive angles. The computing system can use the digital twin and the ocean physics model to simulate movements of the glider through the ocean to predict where currents of the aqueous medium will carry the glider as the glider dives or surfaces. The system can utilize the forecasted current flow to move the gliders, and thus decrease the energy expenditure of the gliders.

With the simulated movements of the glider, the computing system can determine various commands to operate the glider. The commands can be optimized to reduce energy consumption of the glider, increase accuracy between intended glider positions and actual glider positions, reduce distance traveled by the glider, etc. The commands can be optimized to select a heading, dive angle, surfacing angle, or variable dwell time at a particular depth. For example, the computing system can identify a length of time to dwell at a particular depth to be carried to an intended destination by a current of the aqueous medium. The computing system can run the simulations while the glider is submerged in the medium and/or after the glider surfaces. Responsive to the glider surfacing, the computing system can determine at least one command to navigate the glider based on the simulations, and can transmit the command to the glider. The glider can use the command to navigate and operate the glider.

Because the cloud can run simulations to determine navigation decisions for the gliders, the gliders can operate according to the commands, without using a power intensive, heavy, or large INS system. This can allow the glider to be smaller in size, lighter in weight, and therefore travel farther and longer on a single battery charge. The cloud system can scale to handle the control of various numbers of gliders. For example, the cloud system can include an architecture for spinning up digital twins of a specified number of gliders and run simulations or optimizations with the digital twins to control a large fleet of gliders. Ocean observations from large-scale spatially-persistent arrays of underwater gliders can facilitate addressing various challenges ranging from tropical cyclone prediction to detecting endangered marine mammals. An autonomous glider network equipped with an appropriate sensor (e.g., a conductivity-temperature depth sensor or a passive acoustic monitoring system) deployed in a large grid can provide upper-ocean data to enable better forecast skill or marine mammal detection. In this regard, the cloud system can maintain hundreds or thousands of gliders in spatially persistent position (e.g., organized in a grid) to enable dense upper ocean sampling over long durations in the face of ocean current.

Referring now to FIG. 1, among others, an example system 100 to control an underwater glider or underwater vehicle 105 from the cloud (e.g., computing system 125) is shown. The underwater vehicle 105 can float on, submerge in, or travel through, an aqueous medium. The aqueous medium can be water, oil, or any other liquid. The aqueous medium can be an ocean, a sea, a lake, a flooded area, a canal, or any other body of liquid. The underwater vehicle 105 can include a buoyancy engine that can cause the underwater vehicle 105 to change depth (e.g., dive or surface). The buoyancy engine can change the weight of the underwater vehicle 105 and the center of mass of the underwater vehicle, thus selecting a dive angle or surface angle that the underwater vehicle 105 travels according to. Furthermore, the underwater vehicle 105 can include a ring wing or other rudder to change the heading or direction of travel of the underwater vehicle 105.

The underwater vehicle 105 can communicate with at least one satellite system, e.g., satellite system 110 or satellite system 115. The satellite system 110 can be or include a satellite of a global positioning system (GPS), global navigation satellite system (GNSS), Globalnaya Navigatsionnaya Sputnikovaya Sistema (GLONASS), etc. The underwater vehicle 105 can communicate with one or multiple satellites 110 to determine a location or position 120 of the underwater vehicle 105. The position 120 can be a latitude and longitude of the underwater vehicle 105.

The underwater vehicle 105 can communicate with the satellite system 115 to interface, integrate, or communicate with at least one computing system 125. The satellite system 115 can be a constellation of satellites that implement satellite network access or satellite Internet access. The satellite system 115 can implement a communications network that the computing system 125, the middleware 140, and/or the underwater vehicle 105 can communicate information through (e.g., transmit or receive information through). The underwater vehicle 105 can transmit data to the computing system 125 via the satellite system 115, and can receive data from the computing system 125 via the satellite system 115. For example, the underwater vehicle 105 can transmit its position 120 to the computing system 125. Furthermore, the underwater vehicle 105 can receive commands 135 from the computing system 125.

The satellite system 115 can interface or communicate with the computing system 125 via middleware 140. The middleware 140 can interface between the computing system 125 and the underwater vehicles 105 via the satellite system 115. The middleware 140 can be an orchestration system that makes requests to the computing system 125 or sends data to the underwater vehicle 105. For example, the middleware 140 can detect, based on communication with the underwater vehicle 105, that the underwater vehicle 105 has surfaced, and can transmit a request to the computing system 125 to generate new commands 135 for the underwater vehicle 105. The middleware 140 can receive the new commands 135 from the cloud computing system 125, and can send the new commands 135 to the underwater vehicle 105 to cause the underwater vehicle 105 to operate. In some implementations, the middleware 140 can orchestrate a set or group of different underwater vehicles 105. The middleware 140 can detect when one or multiple underwater vehicles 105 of the set surfaces, cause the computing system 125 to generate new commands 135 for the surfaced underwater vehicles, and can distribute the commands 135 to one or multiple different underwater vehicles 105.

The computing system 125 can be located remote from the underwater vehicle 105. For example, the computing system 125 can be located on a boat, in an airplane, in a building or warehouse on land, etc. The computing system 125 can be a cloud platform or cloud computing service. The computing system 125 can be/include a server or server system. The cloud computing system 125 can be/include a remote server. The computing system 125 can include memory devices to store instructions to execute an ocean model service 150 and/or a simulator 155 on one or more processors of the computing system 125. The computing system 125 can include various network interfaces to integrate with networks, e.g., via the middleware 140, to communicate to the satellite system 115 and/or the underwater vehicles 105.

The computing system 125 can communicate with, integrate with, or otherwise receive data from an environmental dataset source 145. The environmental dataset source 145 can be a national oceanic and atmospheric administration (NOAA) computing system, the NOAA Real Time Ocean Forecasting System (RTOFS), the hybrid coordinate ocean model (HYCOM) system, an Operational Mercator Global Ocean Forecast System, etc. The environmental data source 145 can provide a model, such as a hydrodynamics model, that identifies currents of the aqueous medium at a variety of depths (e.g., from the surface of the medium to a bottom or ocean floor of the medium) and at a variety of longitude and latitude positions. The environmental data source 145 can provide a three dimensional hydrodynamic ocean circulation model, that can include velocity vectors, temperature, and salinity at various x, y, and z positions (e.g., latitudes, longitudes, and depths). The identified currents can be vectors, indicating the speed and direction of currents at the various lateral and depth positions. The model can include timesteps of 1 hour, 2 hour, 3 hours, etc. The model can be a forecast for the next 24 hours, the next 48 hours, the next 74 hours, etc. The models or datasets received from the environmental dataset source 145 can have a rough or low resolution. For example, grid boxes of the model can have a 1 kilometer to 10 kilometer resolution. The forecast model 205 and the observation data 210 can be public environmental datasets or private environmental datasets. The observation data 210 and numerical forecast model 205 output by the environmental dataset source 145 can used as inputs to an ocean simulation performed by the ocean model service 150. The forecast can be received from the NOAA or another agency that runs regional models. However, there are many gaps in coverage. Depending on the region where the underwater vehicles 105 need to be deployed, custom regional models with high accuracy can be developed by the computing system 125.

The computing system 125 can include at least one ocean model service 150. The ocean model service 150 can generate, build, or construct an ocean map or model 160 using historical ocean current data and/or a maritime topography. The ocean model service 150 can execute ocean modeling physics to down sample the forecasted maps or models received from the environmental dataset source 145 to generate the high resolution map or model 160. In some implementations, the forecast models can be built at least partially from historical weather trends, and therefore, the ocean model 160 can be indirectly (or directly) built from historical weather trends. During initial creation of the high resolution model 150, the ocean physics simulator 215 can use the bathymetry or maritime topography data of the observation data 210 to create the initial high resolution model 150. In some implementations, the ocean physics simulator 215 can rapidly spin up new forecast models for new geographic regions responsive to receiving a mission plan 245 for a specific geographic region. In some implementations, new models spun up can rely at least in part on older models for nearby or overlapping geographic regions. The ocean physics simulator 215 can use the forecast model 205 to forecast ocean boundaries and ocean currents, while a weather forecast can be used to simulate surface currents. The forecast map can be a map of currents at a first resolution. The downscaled map can include currents at a second resolution, higher than the first resolution. The second resolution can be at least twice as the first resolution. A ratio of the second resolution to the first resolution can be 10.1-10.2, 10.0-10.3, 9.9-10.4, less than 9.9, more than 10.4.

With the publicly available current data received from the environmental dataset source 145, the ocean model service 150 can apply high-resolution interpolation, and can develop a map or ocean model 160 of expected currents at relevant depths when the underwater vehicles 105 are deployed. The result of the physics simulation of the ocean physics simulator 215 can be a custom three dimensional (plus time) hydrodynamic ocean model for a region of interest that has a higher resolution (e.g., smaller grid boxes) than the forecast model 205. The high resolution model 160 can be specific to a geographic region of interest where the underwater vehicles 105 are deployed, are operating in, or will operate in. The high resolution model 160 can have grid boxes with resolution of 100 meters or less. The high resolution model 160 can further have a timescale on the order of seconds or minutes, or can be subsampled to higher timesteps (e.g., ten minute timesteps, half hour timesteps) to reduce model size. The high resolution model 160 can include a timeseries of depth, temperature, and current for various grid boxes at different latitudes, longitudes, and depths. Therefore, the ocean model service 150 can downscale the model to 100 meters or less to accurate navigate the underwater vehicle 105. With the downscaled current data model 160, station-keeping algorithms that the simulator 155 runs or navigation algorithms that the simulator 155 or observing networks run.

The computing system 125 can include at least one simulator 155. The simulator 155 can simulate the movements of the underwater vehicle 105 using the high resolution hydrodynamics model 160. The simulator 155 can simulate movements of the underwater vehicle 105 submerged in and traveling through an aqueous medium, or floating on a surface of the aqueous medium. The simulator 155 can determine, based on hydrodynamics model 160, movements of the underwater vehicle 105. The simulator 155 can determine, for different headings, dive angles, dive depths, or rise angles, how the underwater vehicle 105 is to move through the aqueous medium based on the currents of the aqueous medium.

The simulator 155 can store or generate a digital twin for each underwater vehicle 105. The digital twin can model the behavior of an underwater vehicle 105. The digital twin can refer to or include a virtual representation of the underwater vehicle (e.g., a glider), and can be used to simulate, predict or optimize control of the underwater vehicle. The digital twin can integrate data from various sources to establish a dynamic model that can mirror the underwater vehicle. For example, the digital twin can be a data structure that indicates the nominal or a-priori behavior of the underwater vehicle 105. For example, the data structure can store data collected from test operations of the underwater vehicle 105 in an aqueous body with no or minimal current (e.g., a testing pool). The simulator 155 can create a digital twin for each underwater vehicle 105 in a fleet of underwater vehicles, and can run a mission forward in time. This simulation can predict where underwater vehicles 105 are expected to surface after a sortie or after a sequence of sorties. The simulator 155 can simulate movements of the glider 105 using the digital twin and the model 160. For example, the simulator 155 can generate a data structure that indicates movements of the underwater vehicle 105 at a variety of depths with a variety of headings. The simulator 155 can generate the data structure by summing a-priori vectors that indicate velocity and direction of the underwater vehicle for a variety of different headings and dive angles at a variety of different depths with vectors of the ocean model 160 indicating the velocity and direction of ocean currents at a variety of different depths.

The simulator 155 can run optimizations to efficiently determine the commands 135 to operate the underwater vehicle 105 using the simulated movements of the underwater vehicle 105. The simulator 155 can run an optimization that optimizes (e.g., maximizes, increases, minimizes, or decreases) one or multiple parameters. The simulator 155 can run an optimization that balances multiple parameters, e.g., identifies commands 135 that reduce energy consumed by the underwater vehicle 105, reduces a total distance travelled by the underwater vehicle 105, reduces wear on components of the underwater vehicle 105, reduces a total depth that the underwater vehicle 105 submerges to, reduces a length of time that the underwater vehicle 105 is submerged, etc.

The simulator 155 can run a simulation and optimization for a single underwater vehicle 105. The simulator 155 can further run a simulation of movements of multiple underwater vehicles 105, and can optimize the movements of multiple underwater vehicle 105 together. For example, the simulator 155 can sum together parameters that describe the performance of multiple underwater vehicles 105, and can optimize the parameters. For example, the optimized, minimized, or reduced parameters can be total energy expended by the underwater vehicles 105, total distance traveled by the underwater vehicles 105, total wear on components of the underwater vehicles 105, etc. The result of the optimization can be control commands 135 for a fleet of underwater vehicles 105, which the middleware 140 can distribute to each individual underwater vehicle 105.

In some implementations, when the underwater vehicle 105 surfaces, the underwater vehicle 105 can transmit its position 120 to the middleware 140 through the satellite system 115. The underwater vehicle 105 can transmit a notification to the middleware 140 that the underwater vehicle 105 has surfaced. The underwater vehicle 105 can transmit a request to the middleware 140 for new commands 135. Based on the data transmitted by the underwater vehicle 105, the middleware 140 can detect that the underwater vehicle 105 has surfaced. Responsive to detecting that the underwater vehicle 105 surfaced, the middleware 140 can transmit a request to generate waypoints to the computing system 125. The computing system 125 can execute the simulator 155 on the model 160 using the position 120 of the underwater vehicle to navigate the underwater vehicle 105 to a new destination or set of destinations. For example, the simulator 155 can determine a set of sorties of the underwater vehicle 105 to dive and surface according to.

Each sortie can include a set of control decisions or control commands 135. The commands 135 can specify a heading for the underwater vehicle 105 to travel at, e.g., degrees with respect to North. The commands 135 can specify a pitch, glide path, glide angle, or angle 170 for the underwater vehicle 105 to dive or surface at. The angle 170 of underwater vehicle motion can be measured relative to an axis perpendicular with an ocean floor or a surface and a direction that the underwater vehicle 105 is traveling. The commands 135 can specify a duration for the underwater vehicle 105 to submerge in the aqueous medium. For example, the duration can be a length of time from when the underwater vehicle 105 begins a dive to when the underwater vehicle surfaces. The underwater vehicle 105 can operate such that a maximum depth 175 is reached half way through the duration. The underwater vehicle 105 can operate a buoyancy engine 130 to change the center of mass and buoyancy of the underwater vehicle 105 to achieve a particular commanded glide angle 815. In some implementations, the underwater vehicles 105 can have a maximum depth of 400 meters, 390-410 meters, 380-420 meters, less than 380 meters, or more than 420 meters. The maximum depth can ensure that the underwater vehicles 105 can surface rapidly and obtain a GPS position 120.

The underwater vehicle 105 can receive at least one depth command 175 that indicates a depth for the underwater vehicle 105 to dive to or pause at. Furthermore, the commands 135 can include a length of time for the underwater vehicle to pause and float at a desired depth 175. For example, the underwater vehicle 105 can include a pressure or depth sensor that indicates the depth of the underwater vehicle 105. Responsive to reaching the specified depth 175, the underwater vehicle 105 can surface at a specified angle 170 if the commands 135 indicate that the underwater vehicle 105 should surface responsive to reaching the depth 175. In some implementations, the command 135 can indicate a length of time to pause and float at the depth 175 to be carried by a current indicated by the ocean model 160. The underwater vehicle 105 can use at least one timer to pause at the depth for the length of time indicated by the commands 135, and surface at a specified angle 170 responsive to the length of time passing. In some implementations, the commands 135 can cause the underwater vehicle 105 to glide and pause at multiple different depths, e.g., pause at one or more depths while the underwater vehicle 105 descends, pause at a lowest depth that the underwater vehicle 105 reaches, and/or pause at one or more depths as the underwater vehicle 105 surfaces.

In some implementations, the computing system 125 can generate commands 135 to implement one or multiple sorties to reach one or multiple waypoints. For example, the computing system 125 can generate commands 105 for the underwater vehicle 105 to implement multiple sequential sorties of diving and surfacing (e.g., sorties for the next 24, 48, or 72 hours). Responsive to surfacing after one of the sorties, the underwater vehicle 105 can wait at the surface a set period of time for the computing system 125 to send an updated list of sorties. If the set period of time passes without receiving an update, the underwater vehicle 105 can continue on the previous sequence of sorties. In this regard, the underwater vehicle 105 can continue operating even when the computing system 125 becomes unavailable or is unable to send new commands.

Figure 2:
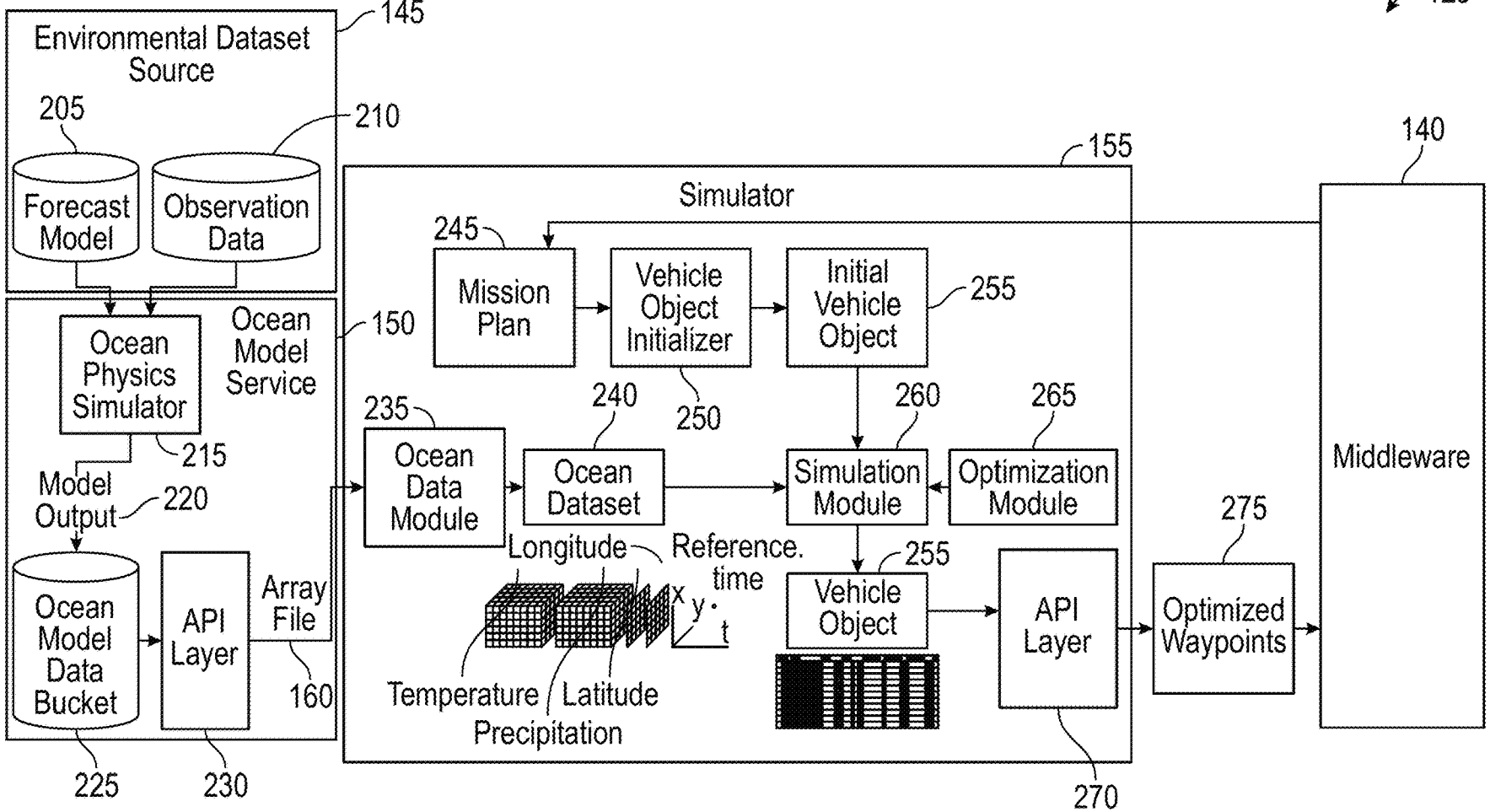
FIG. 2 is an example computing system to simulate an ocean model and determine commands to control an underwater vehicle using the ocean model.

Referring now to FIG. 2, among others, an example computing system 125 to simulate an ocean model 160 and determine commands 135 to control an underwater vehicle using the ocean model 160 is shown. The computing system 125 can be coupled with at least one environmental dataset source 145. The environmental dataset source 145 can be at least one computing system, desktop computer, server system, etc. The computing system of the environmental dataset source 145 can be a cloud platform, a cloud computing service, a server system, or a remote server.

The environmental dataset source 145 can generate, collect, or store at least one forecast model 205. The forecast model 205 be a weather forecast indicating temperature, humidity, rain, snow, or other environmental conditions for a variety of areas or positions. The forecast model 205 can be or include a global ocean model that predicts currents of the ocean or another body of water at the surface and/or at a variety of depths. The forecast model 205 can indicate ocean currents at a variety of positions or grid boxes, e.g., regions of resolution. The forecast model 205 can be a NOAA forecast model, a RTOFS forecast model, a HYCOM forecast model, an Operational Mercator Global Ocean Forecast System model, etc. The forecast model 205 can be a hydrodynamics model that identifies currents of the aqueous medium at a variety of depths (e.g., from the surface of the medium to a bottom or ocean floor of the medium) and at a variety of longitude and latitude positions. The forecast model 205 can include timesteps of 1 hour, 2 hour, 3 hours, etc. The forecast model 205 can be a forecast for the next 24 hours, the next 48 hours, the next 74 hours, etc.

The models or datasets received from the environmental dataset source 145 can have a rough or low resolution. For example, grid boxes of the model can have a 1 kilometer to 10 kilometer resolution. For example, NOAA's RTOFS, the US Navy's HYCOM, and the Operational Mercator Global Ocean Forecast System can have a horizontal resolution of approximately 1/12 degree (approximately 9 km). However, 9 km is too coarse to resolve many bays, bathymetric features, and global chokepoints, leading to a key weakness in using these global models directly for underwater vehicle control. Therefore, the ocean physics simulator 215 can implement low-resolution global models to employ downscaled regional models with higher-resolution and, often, additional physical forcing conditions for improved accuracy.

The environmental dataset source 145 can include observation data 210. The observation data 210 can include measured, sensed, or collected data values, timeseries, measurements, detections, etc. The observation data 219 can include Bathymetry data. The Bathymetry data can be or include a topographic map of a bed or floor of an aqueous body, e.g., an ocean floor, a lake bed, a river bed, etc. The observation data 210 can include satellite tide data. For example, the satellite tide data can indicate ocean tides at a variety of positions generated from satellite imagery captured by satellite systems.

The ocean model service 150 can receive the forecast model 205 and the observation data 210 from the environmental dataset source 145. The ocean model service 150 can include at least one ocean physics simulator 215. The ocean physics simulator 215 can execute one or more physics simulations to generate higher resolution forecast data. For example, the ocean physics simulator 215 can generate ocean current forecasts with grid boxes smaller than the grid boxes of the forecast model 205. The ocean physics simulator 215 can run to output a model 220 including the downscaled high resolution ocean current data. For example, the grid boxes of the high resolution ocean current data can be 90-110 meters, 80-120 meters, less than 80 meters, or more than 120 meters. A ratio of the size of the original grid boxes of the forecast model 205 and the down sampled grid boxes can be 9.9-10.1, 9.8-10.2, less than 9.8, or more than 10.2.

The output model 220 can be stored in an ocean model data bucket 225. The bucket 225 can be a repository to store each model 220 output by the ocean physics simulator 215. For example, the ocean physics simulator 215 can run periodically as new forecast models 205 and new observation data 210 is collected. Each time a model 220 is output by the ocean physics simulator 215, the model 220 can be stored in the bucket 225. The model outputs 220 can be stored as network Common Data Form (netCDF) files, hierarchical data format version 5 (HDF5) file, geospatial information systems (GIS) files, GRIdded Binary (GRIB) files, or any other type of data file or data structure. The ocean model data bucket 225 can be a cloud storage system, e.g., AMAZON WEB SERVICES (AWS) S3, MICROSOFT AZURE, etc.

The ocean model service 150 can include at least one application programming interface (API) layer 230. The API layer 230 can provide an interface between the ocean model service 150 and the simulator 155. The simulator 155 can send a request to the API layer 230 for a current forecast model, and can receive the ocean model 160 from the ocean model service 150 in response. The API layer 230 can retrieve an ocean model 160 from the ocean model data bucket 255, and can respond to the simulator 155 with the model 160. The model 160 can be an array file that stores ocean current vectors for a variety of dimensions, e.g., latitude, longitude, depth, and time. The model 160 can include multiple grid boxes at latitudes, longitudes, and depths that include a current vector. The model 160 can be stored as netCDF file. The model 160 can be stored as a HDF5 file, a GIS file, a GRIB file, or any other type of data file or data structure. The API layer 230 can be a Representational State Transfer (REST) API that receives requests from the simulator 155 or another system, and handles authentication as well as the logic of retrieving the correct datasets for the request from the ocean model data bucket 225.

The simulator 155 can include at least one ocean data module 235. The ocean data module 235 can implement logic, API requests, API responses, etc. to request and receive the high resolution ocean model 160 from the ocean model service 150. The ocean data module 235 can open and load the received file 160. The ocean data module 235 can save the received data as an ocean dataset 240. The ocean dataset 240 can be an unpacked or saved version of the file 160. The ocean dataset 240 can be a dataset object including four dimensional (e.g., longitude, latitude, depth, and time) for a variety of parameters, including ocean current, temperature, and salinity for a region of the ocean. The ocean dataset 240 can, in some implementations, be an xarray dataset object. In some implementations, the ocean dataset 240 can be stored as multiple arrays, such as NumPy arrays.

The simulator 155 can include at least one mission plan 245. The mission plan 245 can be a data file indicating a plan for deploying, operating, and/or collecting at least one underwater vehicle 105 or a fleet of underwater vehicles 105. The mission plan 245 can indicate the number, type, or model of underwater vehicles 105 to be deployed for a mission. The mission plan 245 can specify specifications of the mission, such as the starting time of the mission, starting locations for the underwater vehicles 105, target locations for the underwater vehicles 105 to navigate to or station-keep at, and target dive depths for the underwater vehicles 105 to dive to. For example, underwater vehicles 105 can take measurements at a variety of depths, and the target dive depth can indicate that lowest depth that measurements should be taken at. The mission plan 245 can be a JavaScript Object Notation (JSON), JSON5, Extensible Markup Language (XML), CoffeeScript Object Notation (CSON), etc.

The simulator 155 can include at least one vehicle object initializer 250. The vehicle object initializer 250 can initialize initial vehicle objects 255 based on the mission plan 245. The initializer 250 can convert the mission plan 245 into vehicle objects 255. For example, the initializer 250 can generate or spin up an initial vehicle object 255 for each underwater vehicle 105 referenced in the mission plan 245. The vehicle objects 255 can be generated from templates or classes that store all the initial data. The initializer 250 can generate an initial vehicle object 255 with the template, by generating a copy or instance of the template with a name or identifier of a corresponding physical underwater vehicle 105. The initializer 250 can store different templates for different types of vehicles or different models of vehicles. For example, if the mission plan 245 includes multiple types of underwater vehicles, the initializer 250 can initialize a vehicle object 255 for each underwater vehicle 105 based on the corresponding template for the underwater vehicle type.

The initial vehicle object 255 can be an empty or semi-empty data object. The initial vehicle object 255 can be or include a data frame or spreadsheet that can hold or store simulated data through each timestep of a simulation. The data frame can store a location of the underwater vehicle, a depth of the underwater vehicle, a speed of the underwater vehicle, a heading of the underwater vehicle, ocean currents, temperature, salinity, or other information. The data frame can indicate a-priori or nominal characteristics of the underwater vehicle 105. The characteristics can be default characteristics determined through experimentation or measurements in a controlled or laboratory setting, e.g., within a test pool. The default characteristics can indicate the behavior of the underwater vehicle when there is no or is minimal current, e.g., in a pool. For example, the characteristics can be horizontal speed of the underwater vehicle 105 for various glide angles 170, vertical speed of the underwater vehicle 105 for various glide angles 170, etc.

The simulation module 260 can run a simulation with the ocean dataset 240 and the initial vehicle object 255 to produce a filled version of the vehicle object 255 (e.g., a vehicle object 255 with data elements filled out with data values). The simulation module 260 can receive an indication of the position 120 reported by the underwater vehicle 105. The simulation module 260 can interpolate the ocean dataset 240 to the position 120 reported by the underwater vehicle. With the interpolated ocean dataset 240, the simulation module 260 can update the position of the underwater vehicle 105 in the vehicle object 255 to factor in the effects of ocean currents. The simulation module 250 can sum a velocity vector indicating ocean current at the reported position 120 and future positions of the underwater vehicle 105 with a velocity vector of the underwater vehicle 105 indicating a-priori behavior of the underwater vehicle without the effect of the current. The summed vector can indicate velocity or speed of the underwater vehicle 105 over ground (e.g., a speed or velocity of the underwater vehicle 105 relative to a position on an ocean floor, a river bed, or a lake bed). The vectors can be horizontal movement vectors indicating horizontal velocities.

The simulation module 260 can further vary the simulated heading 165, dive angle 170, rise angle 170 of the underwater vehicle 105 through multiple timesteps of the simulation to determine new velocity over ground (e.g., a speed or velocity of the underwater vehicle 105 relative to a position on an ocean floor, a river bed, or a lake bed) when accounting for the velocity vectors of the currents at various depths and positions as indicated by the ocean dataset 240. The simulation module 260 can determine different headings 165 and glide angles 170 to perform sorties of diving and surfacing to move to a destination position or maintain a particular position (e.g., station-keep). The simulation module 260 can determine commands 135 for the underwater vehicles 105 according to modes for each underwater vehicle, which can be indicated by the mission plan 245. The mission plan 245 can indicate an operation mode for each underwater vehicle 105 in a fleet of underwater vehicles (or a single underwater vehicle 105). One mode can indicate that a particular glider 105 should station-keep at a position specified by the mission plan 245. Another mode can indicate that a particular underwater vehicle 105 should move to a particular position. Another mode can indicate that a particular underwater vehicle 105 should move between a set of specified positions. The mission plan 245 can indicate each mode and associated positions, and can indicate points in time where a mode for an underwater vehicle 105 should change. For example, for a first length of time, the mission plan 245 can indicate that the underwater vehicle should move to a specified position to station-keep at. For a second length of time, the mission plan 245 can indicate that the underwater vehicle 105 should station-keep at the specified position. Finally, for a third length of time, the underwater vehicle 105 should move from the station-keeping position to a pick-up position.

The simulator 155 can include at least one optimization module 265. The optimization module 265 can run one or multiple optimization functions, algorithms, or models to optimize (e.g., minimize, maximize, increase, or reduce) a particular parameter or achieve a specific goal. Each optimization function can optimize a different parameter or operate to achieve a different goal. The parameter can be specific to an underwater vehicle 105. In this regard, the optimization function can minimize or reduce the distance traveled by the underwater vehicle 105 to reach one or multiple destinations, maximize or increase a length of time the underwater vehicle 105 can be deployed before needing to be recharged or retrieved, maximize or increase a total distance the underwater vehicle 105 is capable of traveling before needing recharging or retrieval, etc. The parameter can be a global parameter that aggregates parameters of multiple underwater vehicles 105. For example, the optimization module can, in order to efficiently collect measurements for a defined geographic area, determine movements for underwater vehicles 105 to minimize or reduce overall distance traveled in aggregate by multiple underwater vehicles 105, maximize or increase a length of time in aggregate that the underwater vehicles 105 can be deployed before needing to be recharged or retrieved, maximize or increase a total distance in aggregate that the underwater vehicles 105 are capable of traveling before needing recharging or retrieval.

The optimization functions can be mixed integer linear programming techniques, machine learning techniques, or any other type of optimization technique. The optimization module 265 can integrate with the simulation module 260 to determine optimal control commands 135. The optimization module 265 can implement route optimization techniques that can be turned on/off in the mission plan 245. For example, the mission plan 245 can indicate whether the optimization module 265 should be run or not, or can indicate one or multiple times where the optimization module 265 should be run or one or multiple times or time segments where the optimization module 265 should not be run. The optimization module 265 can be turned on or off. For example, the simulator 155 can run with or without the optimization performed by the optimization module 265.

The optimization module 265 can implement optimized station-keeping. The optimization station-keeping can be an optimization to determine control commands 135, informed based on ocean currents, that keeps the underwater vehicle 105 in a predetermined area or near or at a predetermined position. The optimization module 265 can implement current-aware heading determinations. The optimization module 265 can determine, based on predicted ocean current and a desired direction of travel for the underwater vehicle 105, at least one heading 165 that accounts for the ocean current. For example, if the destination is due North from the current position of the underwater vehicle 105, but the ocean currents are to the Northeast, the optimization module 265 can determine to set the heading 165 to be Northwest to take into account the ocean current. The optimization module 265 can determine multiple headings 165 for a variety of depths as the underwater vehicle 105 dives and surfaces to take into account varied ocean current directions at each of the depths.

The optimization module 265 can implement adaptive loiter time optimizations. The underwater vehicle 105 can loiter by waiting at a particular depth with no glide angle or with any propeller system off. The underwater vehicle 105 can loiter by drifting with the current. The adaptive loiter time optimization can include a variable loiter time parameter that the optimization module 265 can use to take advantage of tidal timing and optimized glide heading 165 to correct for or utilize ocean currents. The optimization module 265 can determine at least one length of time to loiter at one or multiple depths 175. The optimization module 265 can determine an optimal length of time to stop at a depth 175. Responsive to reaching the depth 175, the underwater vehicle 105 can operate its buoyancy-engine to equalize its weight with sea water, such that the underwater vehicle 105 does not rise or sink. The underwater vehicle 105 can run a timer for the length of the loiter time. Responsive to the timer reaching a predefined time or the timer expiring, the underwater vehicle 105 can continue diving or rising according to the commands 135. In some implementations, the adaptive loiter time can provide a 36% reduction in total distance traveled, which can directly translate to increased endurance (e.g., length of time the underwater vehicle can be deployed before needing to be collected, recharged, and/or maintained).

The result of the simulation performed by the simulation module 260 and/or the optimization run by the optimization module 265, the vehicle object 255 with populated fields can be output. The output vehicle object 255 can be a data frame produced at the end of the simulation and/or optimization. The data frame can indicate predicted movements of the underwater vehicle 105 according to various commands 135 and predicted ocean currents. The data frame can indicate points in time, e.g., timestamps at intervals (e.g., 5 minute intervals, 10 minute intervals, hour intervals, etc.). The data frame can indicate latitude of the underwater vehicle 105 at each timestep, latitude of the underwater vehicle 105 at each time step, heading angle of the underwater vehicle 105 at each timestep, a depth 175 of the underwater vehicle 105 at each timestep, a dive angle 170 at each timestep, and/or a rise angle 170 at each timestep.

The simulator 155 can include at least one API layer 270. The API layer 270 can convert the simulation data into a format usable by the middleware 140. For example, the API layer 270 can convert the data frame of the vehicle object 255 into another format, such as JSON, JSON5, XML, CSON, etc. The output of the API layer 270 can be a set of optimized waypoints 275. The optimized waypoints 275 can be a converted version of the data frame of the vehicle object 255, or can indicate the commands 135 for various timesteps over a simulation horizon (e.g., a three hour simulation, a four hour simulation, a week long simulation, etc.). The middleware 140 can query the API layer 270 with a request for optimized waypoints 275, and the API layer 270 can respond to the middleware 140 with the optimized waypoints 275.

When the underwater vehicle 105 finishes a sortie, the underwater vehicle 105 can report a new or second position 120. The middleware 140 can receive the second position 120 from the underwater vehicle 105, and can provide the second position 120 to the simulator 155 and/or the ocean model service 150. The ocean model service 150 can receive the vehicle object 255 from the simulator 155. The ocean model service 150 can receive a timestamp when the underwater vehicle 105 surfaced and reported the second position 120. The ocean model service 150 can use the timestamp to retrieve a simulated position of the underwater vehicle 105 from the vehicle object 255. Because the simulated position is retrieved for the timestep when the second position 120 is received, the two positions should match. However, due to errors or inaccuracies in the ocean physics simulator 215, the two positions may not match. The ocean model service 150 can compare the simulated position with the second position 120 to determine a difference or error between the positions. The ocean model service 150 can update the ocean model 160 and/or update the parameters or settings of the ocean physics simulator 215 to reduce or remove future errors. The ocean model service 150 can use the error to improve the accuracy of predicted currents.

With the updated ocean model 160, the simulation module 260 can future simulations to control the underwater vehicle 105. For example, with the updated ocean model 160 and a new position 120 of the underwater vehicle 105, the simulation module 260 can run new simulations for the underwater vehicle 105 with the updated ocean model 160. Because the ocean model 160 is updated, the control decision 135 generated for the underwater vehicle 105 can control the underwater vehicle 105 more accurately, e.g., to actual positions closer to expected positions.

The computing system 125 can, in some implementations, generate data to cause a graphical user interface of a user or client device (e.g., a laptop, a desktop computer, a smartphone, etc.) to display the results of the simulation module 260. For example, the graphical user interface can include a map of a geographic region where the underwater vehicles 105 are deployed, and indications on the map where the underwater vehicles 105 are deployed. The computing system 125 can animate and move the indications of the underwater vehicles 105 to represent the predicted or simulated movements of the underwater vehicles 105 over time. For example, the computing system 125 can render the position indications of the underwater vehicles 105 according to the vehicle objects 255. In some implementations, a user can provide input on the graphical user interface to modify the trajectories or movements of the underwater vehicles 105. The computing system 125 can update the commands 135 based on the inputs received by the user. For example, based on the user input, the computing system 125 can update the mission plan 245 and/or can re-run the simulation module 260 using the user input.

Figure 3:
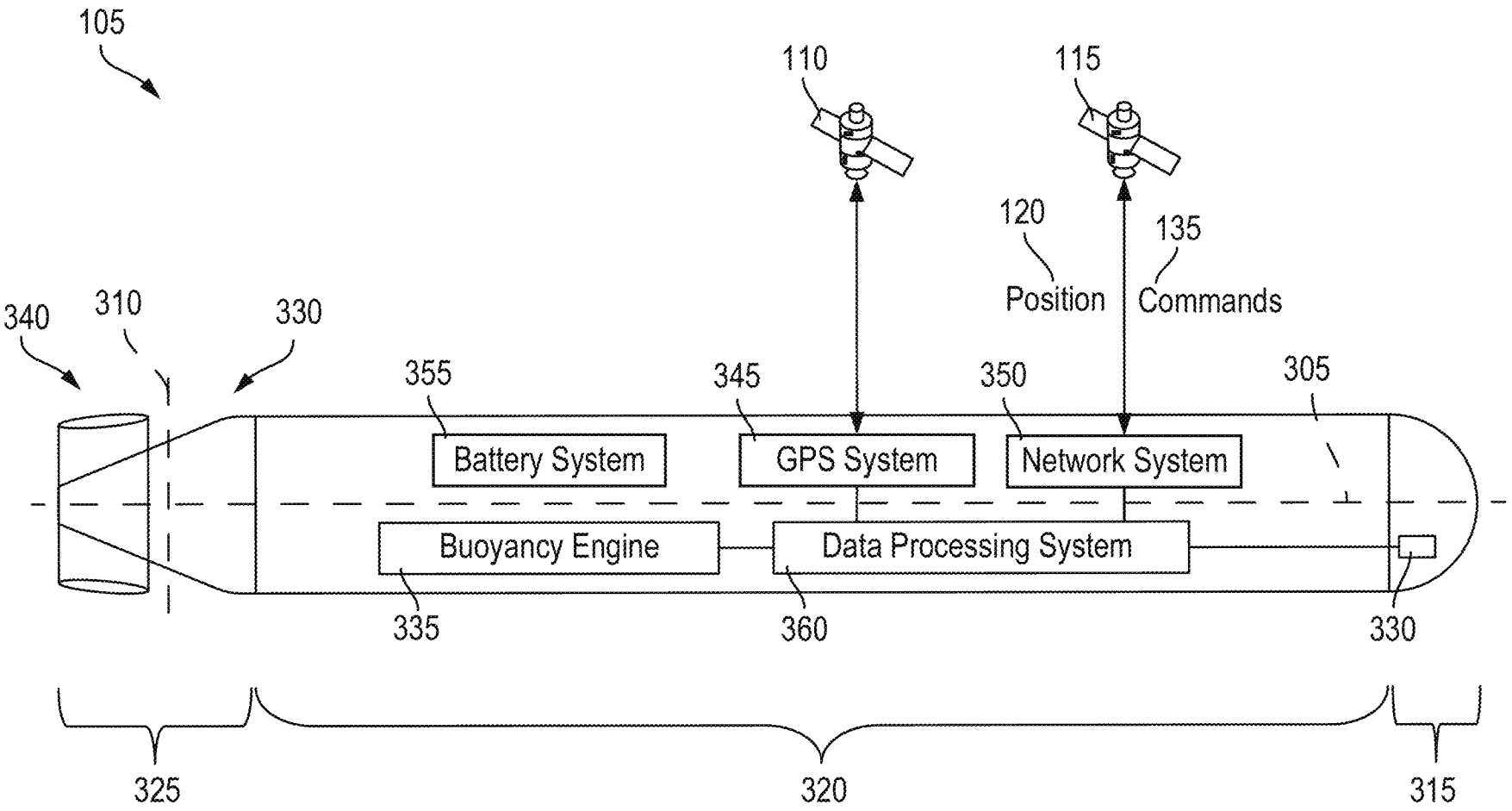
FIG. 3 is an example underwater vehicle that can connect with the cloud to receive commands and autonomously navigate according to the commands.
Figure 4:
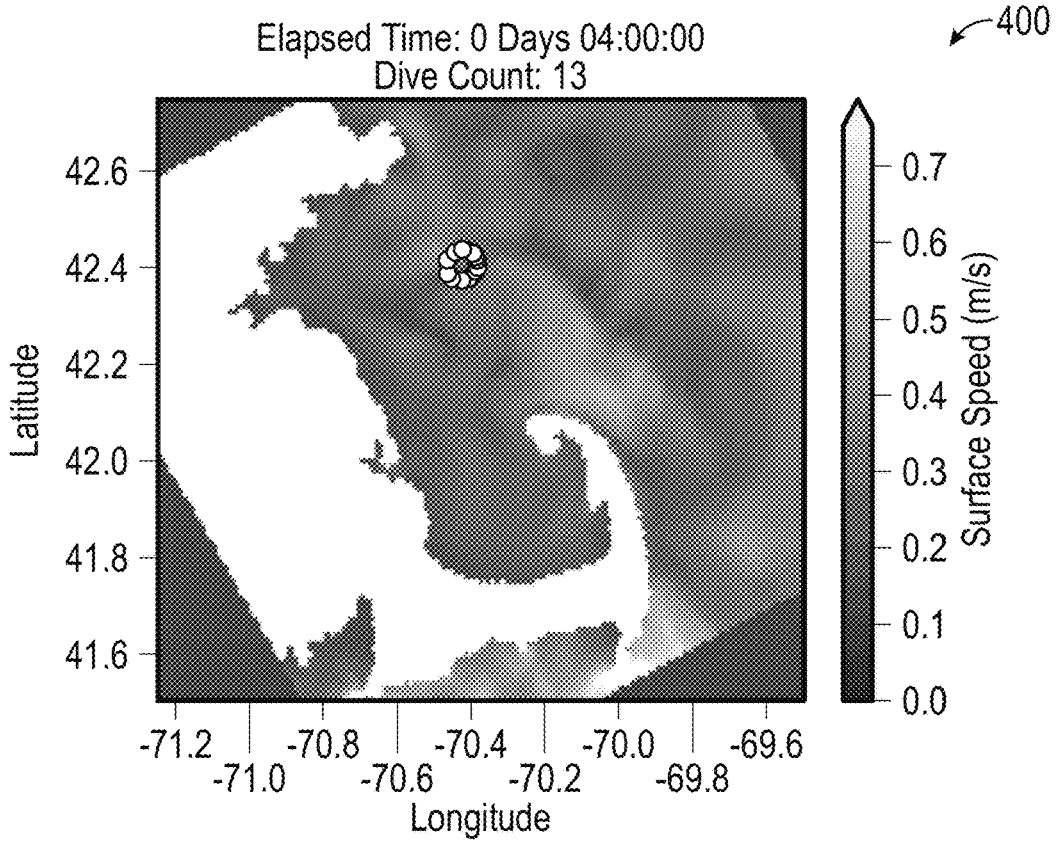
FIGS. 4-7 depict example charts of glider positions where a set of gliders move into a formation.
Figure 5:
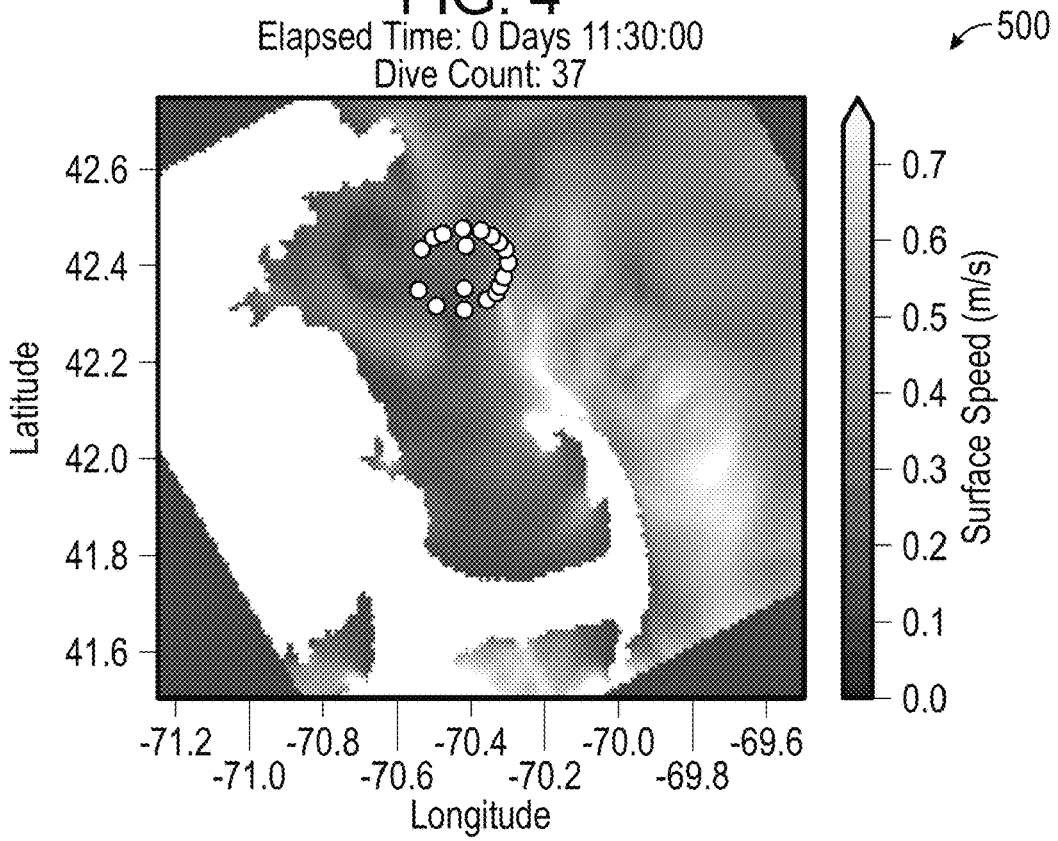
Figure 6:
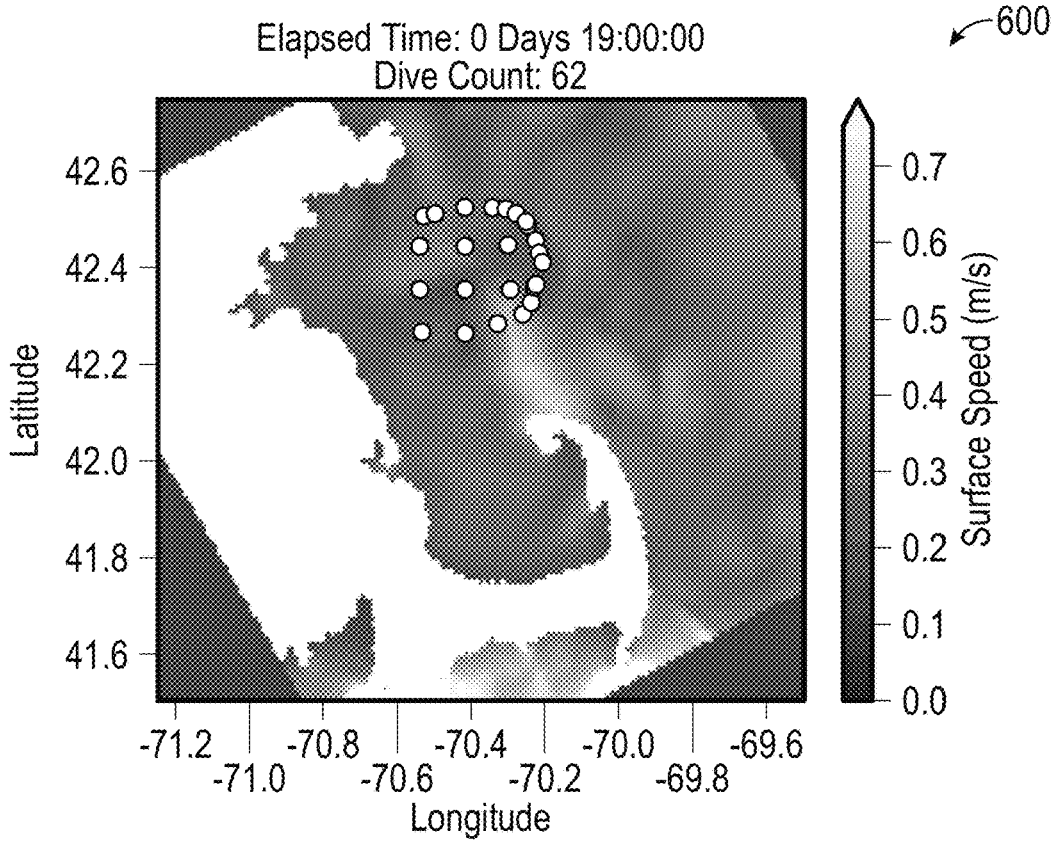
Figure 7:
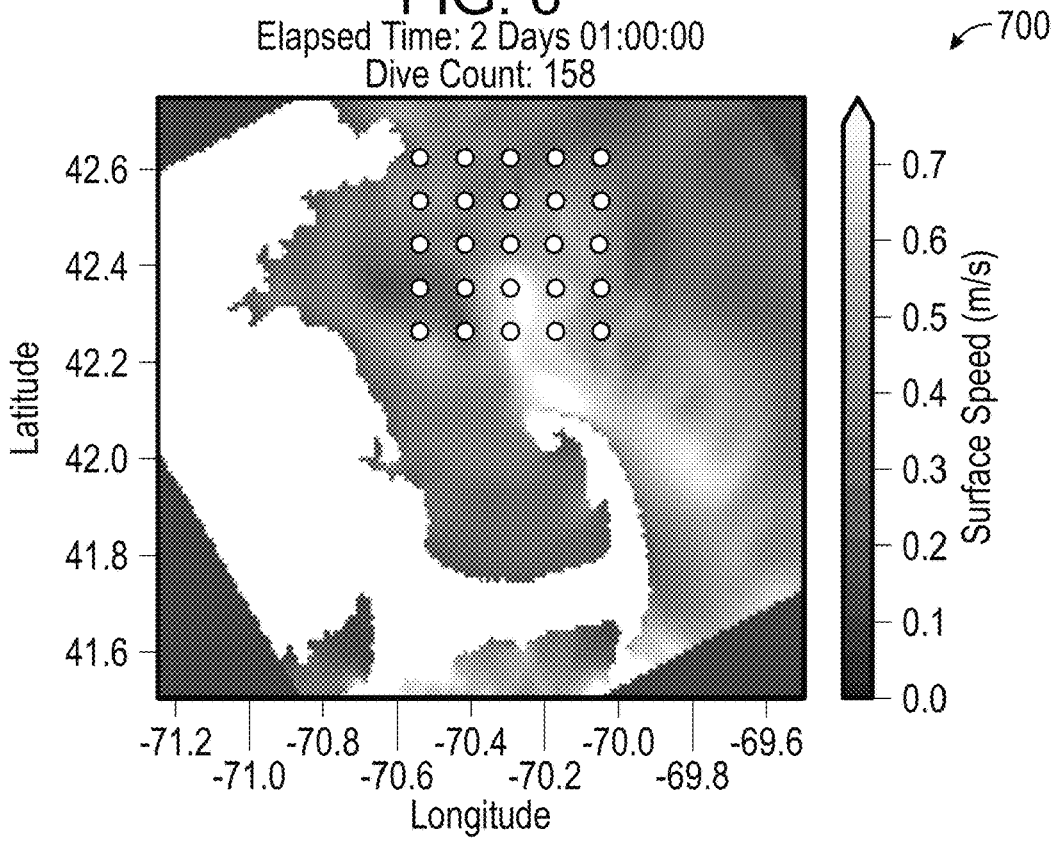
Figure 8:
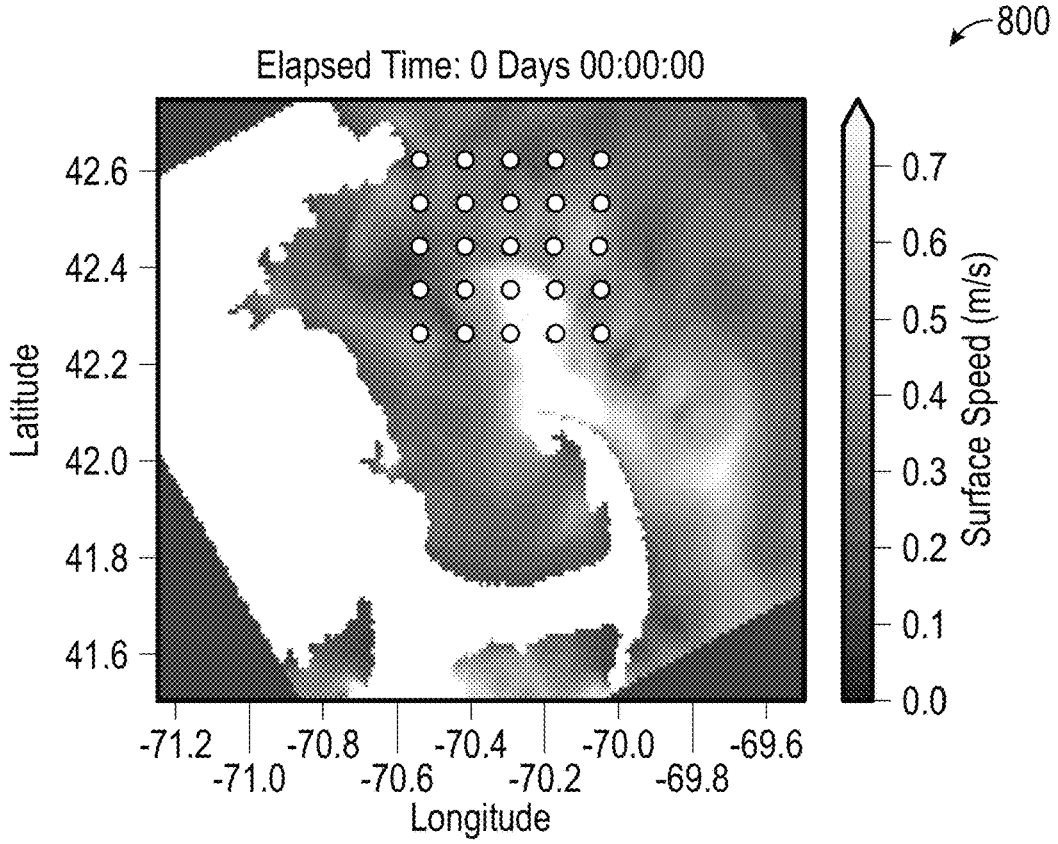
FIGS. 8-11 depict example charts of glider positions where a set of gliders move to pick-up locations.
Figure 9:
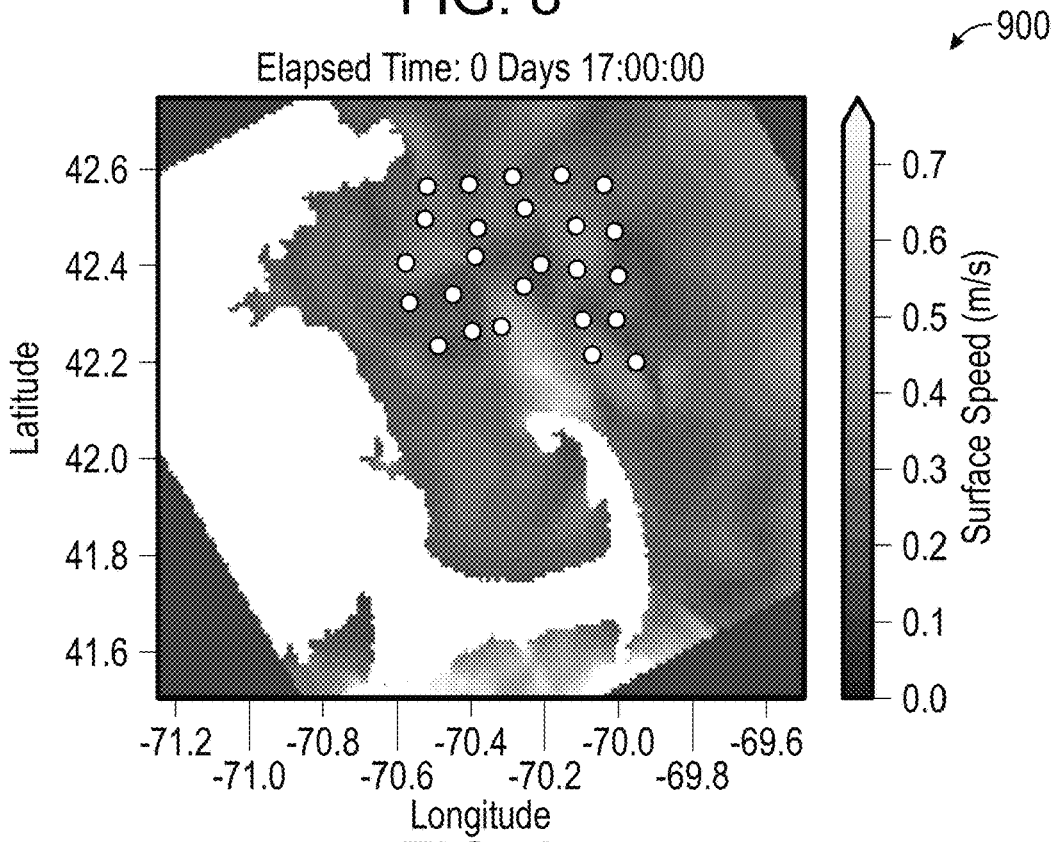
Figure 10:
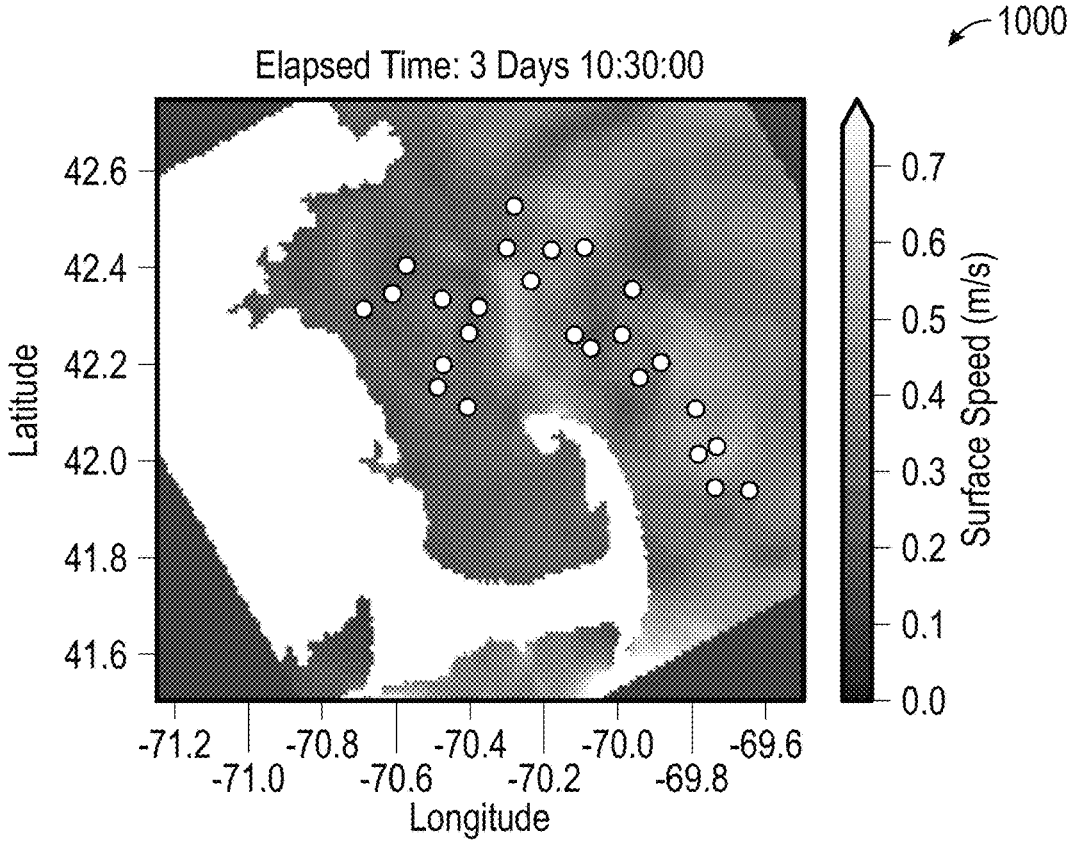
Figure 11:
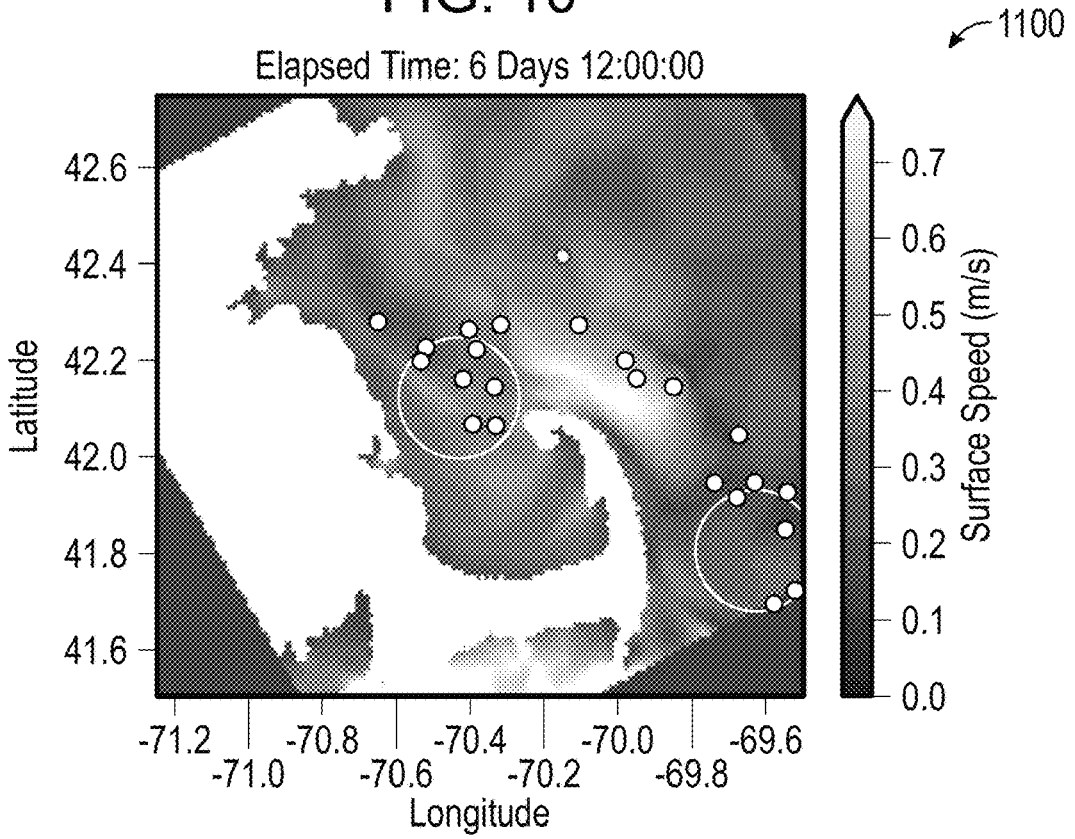

Referring now to FIG. 3, among others, an example underwater vehicle 105 that can connect with the cloud to receive commands and autonomously navigate according to the commands is shown. The underwater vehicle 105 can be a submersible, and can be partially or completely submerge into an aqueous medium. The underwater vehicle 105 can be deployed in the ocean, in a lake, in a flooded area, a canal, or in any other body of liquid. The underwater vehicle 105 can include a longitudinal axis 305, a vertical axis 310, and a horizontal axis. The longitudinal axis 305, the vertical axis 310, and the horizontal axis can be perpendicular to each other. The horizontal axis is not shown in FIG. 1, and can be an angle perpendicular to both the vertical axis 310 and the longitudinal axis 305.

The underwater vehicle 105 can include a front portion 315, a middle portion 320, and a rear portion 325. The front portion 315 can be a nose or leading edge of the underwater vehicle 105. The front portion 315 can carry a payload. For example, the front portion 315 can store, include, or carry at least one sensor 330. The front portion 315 can be formed from, or include, plastic, aluminum, steel and/or any metallic or non-metallic material. The sensor 330 can measure various characteristics of the aqueous medium or the surrounding environment. The sensor 330 can measure temperature, depth, heading, angle of descent, angle of ascent, pressure, distance, location, speed, acceleration, motion, radiation, sound, vibrations and/or other characteristics or property of the underwater vehicle and/or the underwater vehicle's environment (e.g., the aqueous medium, or an object proximate to or in contact with the underwater vehicle). The front portion 315 can be open to the aqueous medium to allow for the aqueous medium to enter at least a portion of the front portion 315 for the sensor 330 to interact with to make measurements. The sensor 330 can measure characteristics of the aqueous medium itself, or measure characteristics that identify other conditions. The sensor 330 can measure an external stimulus on the aqueous medium. For example, the sensor 330 can measure characteristics that identify another vehicle submerged within the aqueous medium, floating on the aqueous medium, or flying above the aqueous medium. The sensor 330 can measure characteristics that indicate ocean life, sea life, or lake life. The sensor 330 can measure characteristics that indicate geologic features or formations, oil, gas, minerals, etc.

The middle portion 320 can be a hull, fuselage, or pressure vessel of the underwater vehicle 105. The pressure vessel can be formed from, or include, plastic, aluminum, or steel, as nonlimiting examples. The middle portion 320 can have a cylindrical shape. The middle portion 320 can have a tubular shape. The middle portion 320 can have a torpedo shape. The middle portion 320 can have a body of revolution shape or a slender body of revolution shape. A body can be slender if/when the ratio between the length and width of the body is 3-4. A body can be slender if the ratio between the length and width of the body is 2.5-4.5. A body can be slender if/when the ratio between the length and width is less than 2.5. A body can be slender if/when the ratio between the length and width can be greater than 2.5. The middle portion 320 can be sealed, and can prevent water from entering a cavity, opening, or space of the middle portion 320. The middle portion 320 can include one or more valves or openings that allow an aqueous medium to enter a compartment, chamber, bladder, or ballast tank of a buoyancy engine 335 or exit the ballast tank.

The middle portion 320 can be sealed or pressurized. The middle portion 320 can be sealed from the front portion 315 or the rear portion 325. The middle portion 320 can be pressurized to 0.9-1.1 atmospheres of pressure. The middle portion 320 can be pressurized to 0.8-1.2 atmospheres of pressure. The middle portion 320 can be less than 0.8 atmospheres of pressure. The middle portion 320 can be pressurized to more than 1.2 atmospheres of pressure.

At least a portion of the buoyancy engine 335 can be disposed within, placed within, fixed within, or installed within the middle portion 320. The buoyancy engine 335 can include a variable buoyancy system. The buoyancy engine 335 can include center-of-gravity control. The buoyancy engine 335 can include one or more pumps, ballast tanks, compressed gas tanks, oil tanks, and/or other components to increase or decrease the weight and buoyancy of the underwater vehicle 105, and/or to control/change the weight distribution or center-of-gravity of the underwater vehicle 105. For example, the buoyancy engine 335 can cause at least one ballast tank to fill with an aqueous medium that the underwater vehicle 105 is disposed within to decrease the buoyancy of the underwater vehicle 105 by increasing the overall weight of the underwater vehicle 105. The buoyancy engine 335 can dispel the aqueous medium from the ballast tank by filling the ballast tanks with a compressed gas, such as air, or another liquid lighter than the aqueous medium, such as a natural oil. Dispelling the aqueous medium from the ballast tanks can increase the buoyancy of the underwater vehicle 105 due to a decreased overall weight of the underwater vehicle 105.

The buoyancy engine 335 can adjust a center of gravity of the underwater vehicle 105. For example, the buoyancy engine 335 can include a sled on which, or in which, one or more components are disposed, e.g., the data processing system 360, the battery system 355, batteries, a battery management system, etc. The buoyancy engine 335 can include at least one motor or actuator that moves the sled within the middle portion 320 towards the front portion 315, away from the front portion 315, towards the rear portion 325, or away from the rear portion 325. By changing the buoyancy and center-of-gravity of the underwater vehicle 105, the buoyancy engine 335 can propel or move the underwater vehicle 105 through or relative to the aqueous medium in multiple directions (e.g., through a combination of gliding, sinking and/or floating dynamics, even if there is no active/powered propulsion system) which can include partially horizontal directions. At least one data processing system 360 can be disposed, included, installed, or provided within the middle portion 320. The data processing system 360 can collect measurements from the sensor 330. The data processing system 360 can generate commands, control decisions, and/or operations to cause the buoyancy engine 335 to change buoyancy or change a center-of-gravity of the underwater vehicle 105. The data processing system 360 can control the buoyancy engine 335 to cause the underwater vehicle 105 to ascend, descend, set a particular speed or velocity for the underwater vehicle 105, set a glide angle for the underwater vehicle 105, or set an angle of attack, or set a heading or orientation (e.g., to point a sensor in a certain direction) for the underwater vehicle 105.

The underwater vehicle 105 can include at least one battery system 355. The battery system 355 can include one or multiple batteries, e.g., lithium-ion batteries, nickel cadmium batteries, lead-acid batteries, etc. The battery system 355 can discharge the batteries to provide power to the buoyancy engine 335, the GPS system 345, the network system 350, the data processing system 360, or the sensor 330. The battery system 355 can include at least one power management or delivery apparatus or circuit. The battery system 355 can charge or discharge the batteries of the battery system 355.

The rear portion 325 can be a stern, trailing surface, or trailing portion of the underwater vehicle 105. The rear portion 325 can include at least one component 330. The component 330 can be formed from, or include, plastic, aluminum, or steel, as nonlimiting examples. The component 330 can have a frustum or cone shape. The component 330 can be hollow or solid. The component 330 can include openings on opposite sides of the component 330. The openings can be circular in shape. The component 330 can have an outer circumference or diameter that decreases or tapers from the middle portion 320 to a tail end of the underwater vehicle 105. A ring wing or ring foil 340 can be coupled, fixedly coupled, connected, joined, formed integrally with, or attached to the component 330.

The rear portion 325 can include at least one ring wing 340. The ring wing 340 can be formed from, or include, plastic, aluminum, steel or other material(s). The ring wing 340 can be or include outer surfaces that provide lift for the underwater vehicle 105. The ring wing 340 can include or be a complete ring or circular structure or a partial ring or circular structure. For example, the ring wing 340 can be formed from one or more segments of a ring structure, some of which can be independently or collectively pivoted or tilted to achieve particular lift and/or steering dynamics relative to the flow or displacement of the aqueous medium. The ring wing 340 can convert a hydrostatic force acting on the underwater vehicle 105 to an upwards lift (e.g., upwards away from the ocean floor or a surface over which the underwater vehicle 105 travels). When the underwater vehicle 105 glides upwards away from a reference point under the underwater vehicle 105, the ring wing 340 can provide a lifting force to propel the underwater vehicle 105, e.g., along at least a partially horizontal direction. When the underwater vehicle 105 glides downwards towards a reference point under the underwater vehicle 105, the ring wing can provide a lifting force to propel the underwater vehicle 105, e.g., along at least a partially horizontal direction. The underwater vehicle 105 can be propelled through the aqueous medium by leveraging on the lift of the lifting surface(s) of the ring wing 105. The underwater vehicle 105 can use lift from the ring wing 340 to travel laterally or achieve significant horizontal range. The underwater vehicle 105 may not include or have to rely on any other thruster or propeller to generate lateral travel.

The overall length of the underwater vehicle 105 can be 0.9 meters long, as an example. The overall length of the underwater vehicle 105 can be 0.8-1.0 meters long. The overall length of the underwater vehicle 105 can be less than 0.8 meters. The overall length of the underwater vehicle 105 can be greater than 1.0 meter long. A diameter of the fuselage 320 of the underwater vehicle 105 can be 12-13 centimeters. The diameter of the fuselage 320 of the underwater vehicle 105 can be 11-14 centimeters. The diameter of the fuselage 320 of the underwater vehicle 105 can be less than 11 centimeters. The diameter of the fuselage 320 of the underwater vehicle 105 can be greater than 14 centimeters. The cone 330 can have (or be at) an angle relative between an outer surface of the middle portion 320 and an outer surface of the cone 330. The angle can be 17-19 degrees. The angle can be 16-20 degrees. The angle can be less than 16 degrees. The angle can be greater than 20 degrees.

The ring wing 340 can have an outer diameter of 11-12 centimeters. The ring wing 340 can have an outer diameter of 10-13 centimeters. The ring wing 340 can have an outer diameter less than 10 centimeters. The ring wing 340 can have an outer diameter greater than 13 centimeters. The ring wing 340 can have a chord length of 2-3 centimeters. The ring wing 340 can have a chord length 1.5-3.5 centimeters. The ring wing 340 can have a chord length less than 1.5 centimeters. The ring wing 340 can have a chord length greater than 3.5 centimeters. A ratio between the outer diameter of the ring wing 340 and a length or chord of the ring wing 340 can be greater than, or equal to one. The ratio between the outer diameter of the ring wing 340 and the chord of the ring wing 340 can be between 2.9-3.1. The ratio between the outer diameter of the ring wing 340 and the chord of the ring wing 105 can be between 2.8-3.2. The ratio between the outer diameter of the ring wing 340 and the chord can be less than 2.8. The ratio between the outer diameter of the ring wing 340 and the chord can be greater than 3.2.

The underwater vehicle 105 can include at least one GPS system 345 and at least one network system 350. In some implementations, the GPS system 345 and the network system 350 are combined into a single system. The GPS system 345 and/or the network system 350 can include at least one antenna, antenna system, transceiver, filter, amplifier, front-end module, etc. The GPS system 345 can implement satellite communication with the satellite system 110. The GPS system 345 can receive signals from at least one satellite of the satellite system 110. The GPS system 345 can determine a position of the underwater vehicle 105 and/or can provide data to the data processing system 360 for the data processing system 360 to determine the position 120 of the underwater vehicle. The GPS system 345 can determine the position 120 using the signals received from satellites. In some implementations, the data processing system 360 can detect that the underwater vehicle 105 has surfaced based on measurements of the sensor 330. For example, the sensor 330 can be a depth or pressure sensor that indicates when the underwater vehicle 105 has surfaced. Responsive to the underwater vehicle 105 surfacing, the data processing system 360 can cause the GPS system 345 to establish a connection with the GPS system 110 and determine the position 120 of the underwater vehicle 105.

Furthermore, responsive to surfacing, the data processing system 360 can cause the network system 350 to establish a connection with the satellite system 115. The data processing system 360 can cause the network system 350 to transmit the position 120 to the satellite system 115 and/or a separate indication (e.g., a notice, a message, a data packet, etc.) that the underwater vehicle 105 has surfaced. The underwater vehicle 105 can transmit the position 120 and/or the indication to the middleware 140 via the satellite system 115. The data processing system 360 can periodically send the position 120 and/or the indication to the middleware 140 until a response is received from the middleware 140. The data processing system 360 can execute or run a timer responsive to surfacing or responsive to first sending the position 120 to the middleware 140. The data processing system 360 can cause the underwater vehicle 105 to wait at or on the surface for the duration of the length of time. For example, the underwater vehicle 105 can wait for ten minutes, a half hour, an hour, two hours, etc. Responsive to the length of time elapsing, the underwater vehicle 105 can determine to operate based on commands 135 received from a previous time the underwater vehicle surfaced 105. For example, the computing system 125 can send the underwater vehicle 105 commands 135 for a sequence or set of sorties to perform one after another. If the underwater vehicle 105 performs a first sortie in the set of sorties, but the underwater vehicle 105 receives no update from the computing system 125 after surfacing, the underwater vehicle 105 can proceed to performing the second sortie in the sequence of sorties.

Responsive to establishing the connection between the underwater vehicle 105 and the computing system 125, the computing system 125 can use the reported position 120 to run additional simulations and/or optimizations to generate new commands 135 for a new sequence or set of sorties, and can transmit the commands 135 to the underwater vehicle 105. Responsive to receiving the commands 135, the data processing system 360 can adjust the weight and center-of-gravity of the underwater vehicle 105 using the buoyancy engine 335 to perform a sortie where the underwater vehicle 105 dives or surfaces with a particular glide angle 170. Furthermore, the data processing system 360 can operate at least one motor or actuator to turn the ring wing 340 about the vertical axis 310 (or the horizontal axis) to steer the underwater vehicle 105 with a desired heading 165. The data processing system 360 can determine when a defined depth 175 is reached using depth measurements of the sensor 330. The data processing system 360 can adjust cause the glide angle 170 to be zero or negligible, and can equalize the weight of the underwater vehicle 105 with surrounding medium to sit or wait at the depth 175 for a predefined length of time (e.g., a length of time indicated by the received commands 135). Responsive to the length of time elapsing, the data processing system 360 can adjust the buoyancy and/or center-of-gravity of the underwater vehicle 105 to achieve a rise angle 170 to rise to the surface at.

In some implementations, the commands 135 can specify data collection instructions for the underwater vehicle 105. For example, the simulator 155 can generate data collection instructions for multiple time steps into the future according to the mission plan 245. The data collection instructions can specify the time or frequency at to measure information with using the sensor 330. For example, the collection instructions can specify that the data processing system 360 should record salinity with a salinity sensor 330 at a first frequency, and that the data processing system 360 should record temperature with a temperature sensor 330 at a second frequency. Responsive to receiving the commands 135 including the data collection instructions, the data processing system 360 can collect and report collected data according to the collection instructions.

The data processing system 360 can monitor at least one characteristic, and can cause the underwater vehicle 105 to surface responsive to the characteristic being met. For example, the characteristic can be the depth 175 being met or a length of time passing that the underwater vehicle 105 stayed at the depth 175. Responsive to the characteristic being met, the underwater vehicle 105 can surface. Responsive to surfacing, the underwater vehicle 105 can determine a new position 120, and can transmit the new position 120 to the computing system 125. Furthermore, the underwater vehicle 105 can transmit data collected by the sensors 330 to the computing system 125. The computing system 125 can receive the new position 120 to run additional navigation simulations for the underwater vehicle 105 and respond with new commands 135. Furthermore, the computing system 125 can receive the collected measurements from the underwater vehicle 105.

In some implementations, the underwater vehicle 105 can submerge for a length of time specified by the commands 135. However, responsive to a characteristic being met (e.g., an event occurring or being generated by the underwater vehicle 105), the underwater vehicle 105 can surface. For example, the characteristic can be a depth that the underwater vehicle 105 should dive to. The characteristic can be a fault or error encountered by the underwater vehicle 105. Responsive to detecting the characteristic, the data processing system 360 can cause the underwater vehicle 105 to surface, can determine a new position 120 and can report the position 120 to the computing system 125. The event can be detecting a particular acoustic signature corresponding to a particular detection, e.g., detecting marine life, such as a whale sound, detecting another underwater vehicle, capturing a set number of data samples, etc.

Referring now to FIGS. 4-7, among others, example charts 400-700 of underwater vehicle positions where a set of underwater vehicles 105 move into a formation is shown. The charts 400, 500, 600, and 700 illustrate the movements of the underwater vehicles 105 controlled by the computing system 125. The computing system 125 can generate an ocean model 160, and can run simulations for multiple underwater vehicles 105 according to a mission plan 245 using the ocean model 160. The mission plan 245 can specify for identify a formation of the underwater vehicles 105, e.g., a position for each underwater vehicle 105 to station-keep at and take measurements. After the underwater vehicles 105 are dropped off at a starting location, and computing system 125 can generate commands 135 for each of the underwater vehicles 105, and the middleware 140 can distribute the commands 135 to each underwater vehicle 105 to navigate each underwater vehicle to its station-keeping position, and can maintain the underwater vehicle 105 at that position. The formation shown in chart 700 is a square shaped grid of underwater vehicles 105. However, a variety of different shaped or sized formations can be implemented by the computing system 125, e.g., a triangle formation, a rectangle formation, etc.

In some implementations, the mission plan 245 can specify a distance for at least two underwater vehicles 105 to maintain from each other. In this regard, the simulator 155 can use positions 120 of multiple underwater vehicles 105 to plan movements of the underwater vehicles 105 to maintain the distance identified by the mission plan 245. The simulator 155 can determine commands 135 for one or multiple underwater vehicles 105 that, when the underwater vehicles 105 move through the aqueous medium according to the commands 135, maintains the distance indicate by the mission plan 245.

By using pre-computed locations of underwater vehicles 105 based on the model 160 of ocean currents and the underwater vehicle 105 dynamics, the underwater vehicles 105 can station-keep or stay within a defined geographic boundary (e.g., a box, a triangle, a rectangle, etc.). The simulator 155 can run the simulations and control across the fleet of underwater vehicles 105 continuously in order to maintain a spatially persistent grids of underwater vehicles 105 over long durations of time in a bounding box (e.g., a box of no more than two square kilometers). This can result in coarse-grained station keeping at this scale.

Referring now to FIGS. 8-11, among others, example charts 800, 900, 1000, and 1100 of underwater vehicle positions where a set of underwater vehicles 105 move to pick-up locations is shown. In charts 800-1100, a fleet of underwater vehicles 105 are shown in a formation. The mission plan 245 can indicate a length of time for the underwater vehicles 105 to station-keep at the positions. Responsive to the length of time expiring, the simulator 155 can generate the commands 135 to navigate the underwater vehicles 105 towards pickup regions or positions 1105. The mission plan 245 can indicate or identify a position or region 1105 where the underwater vehicles 105 should be present at or within at a given time for at least one user to pick up or retrieve the underwater vehicles 105. In some implementations, underwater vehicles 105 that begin in a station-keeping mode, can transition into a pick-up mode according to the mission plan 245. The computing system 125 can use ocean currents to carry the underwater vehicles 105 to designated pickup zones when the transition between modes occurs. The computing system 125 can optimize a parking depth where the underwater vehicles 105 park at a particular depth or sequence of depths to be carried to pick-up locations 1105. The computing system 125 can run optimization to cause the underwater vehicles 105 to reach the pickup zones 1105 faster or slower, such that the underwater vehicles 105 are all within the zone 1105 at a predefined time or within a predefined range of times. For example, underwater vehicles 105 may take 10 days, 9-11 days, 8-12 days, less than 8 days, or more than 12 days to move from a station keeping position to a pickup zone. In some implementations, the computing system 125 can use ocean currents as part of a logistics system by forecasting where underwater vehicles 105 can end up when left to the mercy of ocean currents, and control how the underwater vehicles 105 can arrange themselves in grids using ocean current models.

Figure 12:
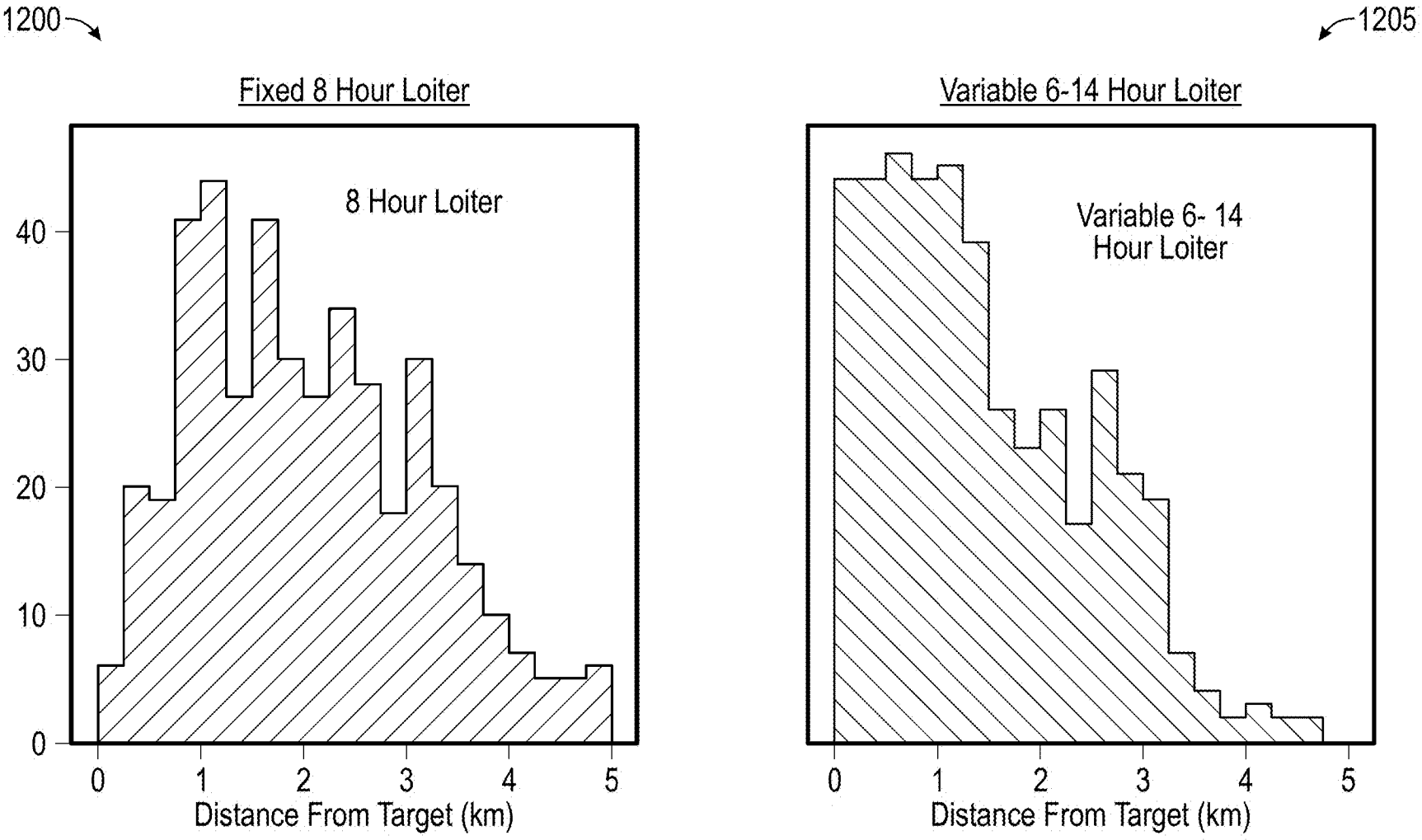
FIG. 12 depicts example charts of distances from a target for gliders controlled via fixed and variable depth loiter times.

Referring now to FIG. 12, among others, example charts 1200 and 1205 of distances from a target for underwater vehicles 105 controlled via fixed and variable depth loiter times are shown. The chart 1200 can indicate results of control of the underwater vehicle 105 based on simulations run by the simulator 155 with a fixed loiter time. The fixed loiter time can be a fixed length of time that the underwater vehicle 105 can wait at a particular depth to be carried by ocean currents. The chart 1200 can indicate results of control of the underwater vehicle 105 based on simulations run by the simulator 155 with a dynamic or variable loiter time. The loiter time can be a variable length of time that the underwater vehicle 105 can wait at a particular depth to be carried by ocean currents. The simulator 155 can adjust, based on ocean currents, the length of time for the underwater vehicle 105 to loiter at a particular depth and be carried by ocean currents. As can be seen, the variable loiter time can have significantly more accurate results.

Figure 13:
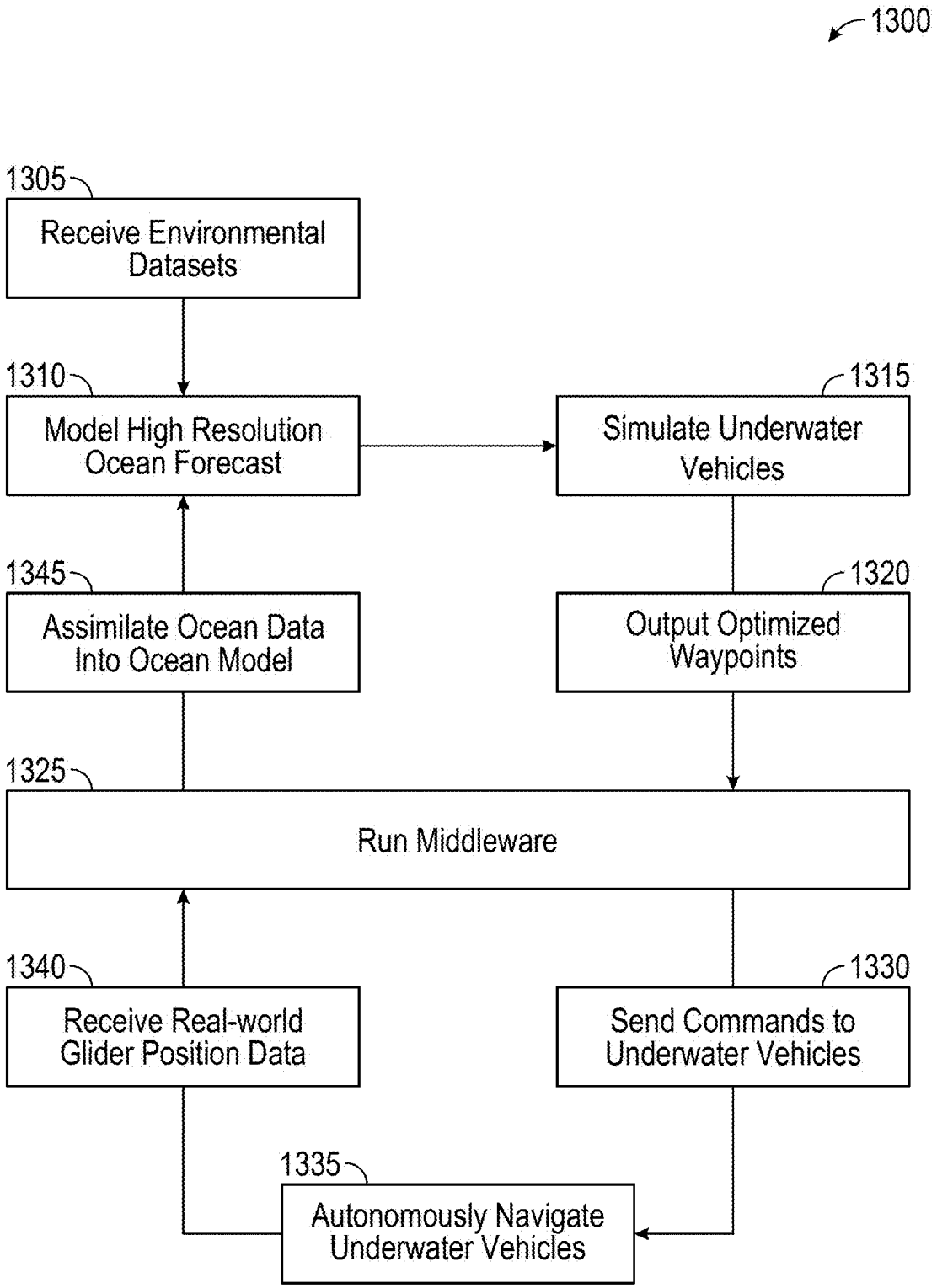
FIG. 13 is an example method of cloud assisted glider control.

Referring now to FIG. 13, among others, an example method 1300 of cloud assisted underwater vehicle control is shown. The method 1300 can include an ACT 1305 of receiving environmental datasets. The method 1300 can include an ACT 1310 of modeling a high resolution ocean forecast. The method 1300 can include an ACT 1315 of simulating vehicles. The method 1300 can an ACT 1320 of outputting optimized waypoints. The method 1300 can include an ACT 1325 of running middleware. The method 1300 can include an ACT 1330 of sending a mission plan to underwater vehicles. The method 1300 can include an ACT 1335 of autonomously navigating underwater vehicles. The method 1300 can include an ACT 1340 of receiving real-world underwater vehicle position data. The method 1300 can include an ACT 1345 of assimilating ocean data into an ocean model. The computing system 125, the middleware 140, the satellite system 115, the satellite system 110, the underwater vehicle 105, the simulation module 260, or the optimization module 265 can perform at least a portion of the method 1300. In some implementations, the ACTS 1305-1335 are performed continuously to implement underwater vehicle control over a duration of time or for a duration of a mission.no At ACT 1305, the method 1300 can include receiving, by the computing system 125, environmental datasets. The method 1300 can include receiving a topography of a floor or bed of a body of an aqueous medium. Furthermore, the method 1300 can include receiving a forecast model 205, such as a hydrodynamics model, that identifies predicted currents of the aqueous medium at a variety of depths (e.g., from the surface of the medium to a bottom or ocean floor of the medium) and at a variety of longitude and latitude positions. The model can include timesteps of 1 hour, 2 hour, 3 hours, etc. The model can be a forecast for the next 24 hours, the next 48 hours, the next 74 hours, etc. Furthermore, the method 1300 can include receiving salinity forecasts, temperature forecasts, humidity forecasts, etc. The method 1300 can include receiving the environmental datasets from a NOAA computing system, the RTOFS, the HYCOM system, or the Operational Mercator Global Ocean Forecast System.

At ACT 1310, the method 1300 can include modeling, by the computing system 125, a high resolution ocean forecast. The method 1300 can include running an ocean physics simulation to down sample the receive ocean forecast. The method 1300 can include increasing the resolution of the ocean forecast, e.g., improving the resolution of ocean current forecasts at various latitudes, longitude, and depths (or at the surface). The method 1300 can include determining an ocean model 160 using the ocean forecast and/or the topography received at ACT 1305. For example, a first time that the ocean model 160 is generated, the model can be generated using the topography. The model 160 can be an ocean current forecast for a local geographic region where the underwater vehicles 105 are operating, e.g., a 100 kilometer area, a 1,000 kilometer area, etc.

At ACT 1315, the method 1300 can include simulating, by the computing system 125, underwater vehicles 105. The method 1300 can include simulating the movement of the underwater vehicles 105 based on the forecasted currents of the ocean model 160. The method 1300 can include generating a vehicle object 255 that provides a data frame of nominal movements or behavior of the underwater vehicles 105. The method 1300 can include simulating movements of the underwater vehicle 105 using the ocean model 150 and the vehicle object 225. For example, at a variety of timesteps into the future, the simulation module 260 can sum a vector indicating ocean currents for a particular position and depth of the underwater vehicles 105 with a movement vector of the underwater vehicles 105 indicating nominal movements or behaviors of the underwater vehicles 105. For each of the underwater vehicles 105, the simulation module 260 can adjust a heading 165 of the underwater vehicle, a dive angle 170 of the underwater vehicle 105, a depth 175 for the underwater vehicle 105 to reach, a rise angle 170 for the underwater vehicle 105 to rise to navigate the underwater vehicle 105 to a position (or stay at a given position) based on the forecasted ocean currents. The method 1300 can include running an optimization module 265 to select optimal control commands 135 (e.g., heading 165, dive angle 170, depth 174, or rise angle 170) to determine a current-aware heading or adaptive loiter time for a specified depth.

At ACT 1320, the method 1300 can include outputting, by the computing system 125, optimized waypoints 275. The method 1300 can include outputting waypoints 725 indicating various sorties for the underwater vehicle 105 to perform and the commands 135 for performing each sortie. The method 1300 can include generating the optimized waypoints 275 from a data frame of the vehicle object 255. The vehicle object 255 can include a data frame that indicates latitude, longitude, heading, depth, dive angle, rise angle, etc. The waypoints 275 can indicate sets of commands 135 based on the data frame of the vehicle object 255. The method 1300 can include outputting a set of optimized waypoints 275 for each underwater vehicle 105.

At ACT 1325, the method 1300 can include running middleware. The method 1300 can include the middleware 140 running to establish a connection via a network (e.g., satellite network) with the underwater vehicles 105 using the satellite system 115. At ACT 1330, the method 1300 can include sending, by the computing system 125, the commands 135 to the underwater vehicles 105. For example, the computing system 125 can send the commands 135 to middleware 140. The middleware 140 can distribute commands 135 to each individual underwater vehicle 105.

At ACT 1335, the method 1300 can include autonomously navigating, by the data processing system 360, the underwater vehicles 105. The method 1300 can include operating, by the data processing system 360, the buoyancy engine 335 using the commands 135 to navigate. For example, the data processing system 360 can operate the buoyancy engine 335 to change the weight and center-of-gravity of the underwater vehicle 105 to dive with a particular dive angle 170 specified by the commands 135, or rise at a particular glide angle 170. The data processing system 360 can further control the ring wing 340 to adjust the heading of the underwater vehicle to a heading 165 specified by the commands 135. The data processing system 360 can cause the underwater vehicle 105 to dive and surface to perform at least one or a sequence of sorties specified by the commands 135.

At ACT 1340, the method 1300 can include receiving, by the computing system 125, real-world underwater vehicle position data 120. The method 1300 can include determining, by the data processing system 360 of the underwater vehicle 105, a position 120 of the underwater vehicle 105. The data processing system 360 can communicate with a satellite system 110 to perform positioning of the underwater vehicle 105, e.g., GPS, GNSS, GLONASS, etc. The underwater vehicle 105 can communicate with one or multiple satellites 110 to determine the position 120 of the underwater vehicle 105. The position 120 can be a latitude and longitude of the underwater vehicle 105. The computing system 125 can receive the position 120 from the underwater vehicle 105 via a satellite system 115 and/or middleware 140.

At ACT 1345, the method 1300 can include assimilating, by the computing system 125, ocean data into an ocean model. For example, the computing system 125 can compare the position 120 with a simulated or expected position of the underwater vehicle 105. The computing system 125 can use a difference or error determined by comparing the actual and simulated position of the underwater vehicle 105 to make updates to the ocean model 160 and/or to the ocean physics simulator 215. In this regard, the ocean model 160 or ocean models 160 generated by the ocean physics simulator 215 over time can increase in accuracy. With the updated ocean physis model 160, the computing system 125 can generate subsequent sets of commands 135 to operate the underwater vehicles 105 on subsequent sorties.

Figure 14:
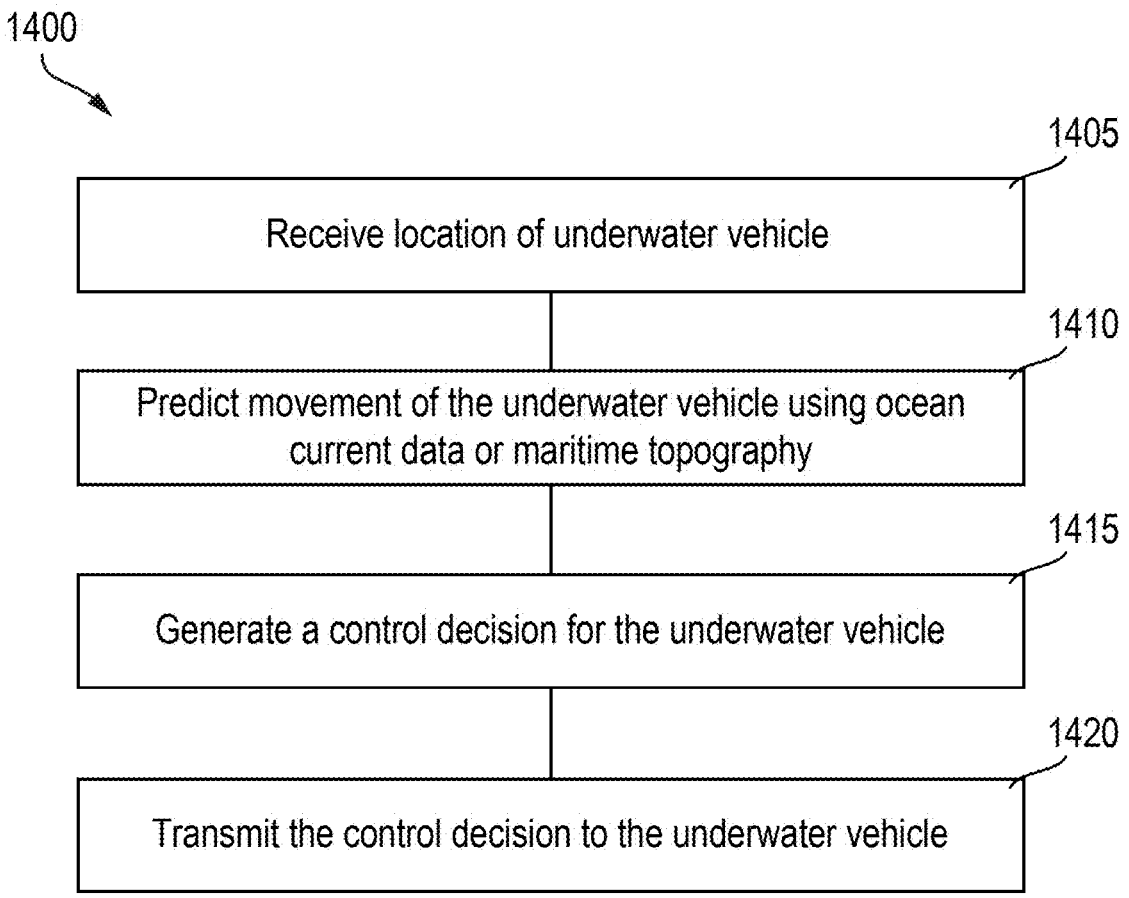
FIG. 14 is an example method of controlling an underwater glider from the cloud.

Referring now to FIG. 14, among others, an example method 1400 of controlling an underwater vehicle 105 from the cloud is shown. The method 1400 can include an ACT 1405 of receiving a location of an underwater vehicle. The method 1400 can include an ACT 1410 of predicting movement of the underwater vehicle using ocean current data or maritime topography. The method 1400 can include an ACT 1415 of generating a control decision or the underwater vehicle. The method 1400 can include an ACT 1420 of transmitting the control decision to the underwater vehicle. The computing system 125, the middleware 140, the satellite system 115, the satellite system 110, the underwater vehicle 105, the simulation module 260, or the optimization module 265 can perform at least a portion of the method 1400.

At ACT 1405, the method 1400 can include receiving, by the computing system 125, a location of an underwater vehicle 105. The location can be a position 120, such as a latitude and longitude of the underwater vehicle 105. The underwater vehicle 105 can perform positioning of the underwater vehicle 105 by communicating with a satellite system 110, e.g., a GPS, GNSS, or GLONASS system. The method 1400 can include communicating with one or multiple satellites 110 to determine the position 120 of the underwater vehicle 105. The position 120 can be a latitude and longitude of the underwater vehicle 105. The computing system 125 can receive the position 120 from the underwater vehicle 105 via a satellite system 115 and/or middleware 140. The method 1400 can include receiving the position 120 from the underwater vehicle 105 via the satellite system 115 and/or the middleware 140. The method 1400 can include receiving the position 120 from the underwater vehicle 105 responsive to the underwater vehicle 105 surfacing. The method 1400 can include sending or transmitting, by the underwater vehicle 105, the position 120 to the computing system 125 via the middleware 140 and/or the satellite system 115.

At ACT 1410, the method 1400 can include predicting movement of the underwater vehicle 105 using ocean current data or a maritime topography. The method 1400 can include receiving, by the computing system 125, a forecast model 205 and/or observation data 210 from an environmental dataset source 145. The forecast model 205 can indicate current data, e.g., various current vectors at a variety of latitudes, longitudes, or depths. The observation data 210 can include a maritime topography, e.g., indicating land masses, islands, the topography of a floor or bed of an aqueous medium, etc. The method 1400 can include down sampling the ocean current forecast to generate a higher resolution ocean model 160 that predicts the direction and speed of ocean currents at a variety of positions (e.g., latitudes, longitudes, and depths). The method 1400 can construct the ocean model 160 at least in part based on the maritime topography. For example, an initial ocean model 160 can be constructed with the maritime topography, and can be updated with the ocean forecast data.

The method 1400 can include predicting, by the computing system 125, the movements of the underwater vehicle 105 using the ocean model 160. The method 1400 can include initializing a vehicle object 255 that includes a data frame that is empty. The data frame can indicate the movements of the underwater vehicle 105 over time steps (e.g., latitudes, longitudes, headings, glide angles, etc.). The vehicle object 255 can include a-priori data that indicates nominal or tested characteristics of the underwater vehicle, e.g., the horizontal or vertical velocity vectors of the underwater vehicle 105 with different dive angles. The method 1400 can include simulating, by the computing system 125, the movements of the underwater vehicle 105 by summing forecasted ocean current vectors with a-priori vectors of the underwater vehicle 105 to predict a speed and direction over ground of the underwater vehicle 105 for different commanded headings 165, glide angles 170, and/or depths 175 of the underwater vehicle 105.

At ACT 1415, the method 1400 can include generating, by the computing system 125, a control decision for the underwater vehicle 105. The method 1400 can include generating commands 135 that can include instructions for performing one or a sequence of sorties where the underwater vehicle 105 dives at a glide angle 170 with a set heading 165 to a depth 175, and then rises to the surface at a glide angle 170 at a heading 165. The method 1400 can include filling out the data frame of the vehicle object 255 with different headings 165 and/or glide angles 170 for each time step. The method 1400 can include optimizing the commands 135 to minimize or reduce a total amount of energy expended by the underwater vehicle 105, maximize or increase an overall distance that the underwater vehicle 105 can travel on a single charge, maximize or increase a battery life of the underwater vehicle 105, minimize or reduce a distance that the underwater vehicle 105 travels to a destination, minimize or reduce a length of time the underwater vehicle 105 takes to travel to a destination, etc.

At ACT 1420, the method 1400 can include transmitting, by the computing system 125, the control decision to the underwater vehicle 105. The method 1400 can include receiving, by the computing system 125, a notification that the underwater vehicle 105 is or has surfaced. Responsive to the underwater vehicle 105 surfacing, the method 1400 can include transmitting, by the computing system 125, the commands 135 to the underwater vehicle 105 via a network implemented by the satellite system 115. In some implementations, the method 1400 can include transmitting the commands 135 to the middleware 140, and the middleware 140 can distribute the commands 135 to the appropriate underwater vehicle by identifying that the underwater vehicle 105 is surfaced and connected to the satellite system 115, and transmitting the commands 135 to the underwater vehicle 105.

Figure 15:
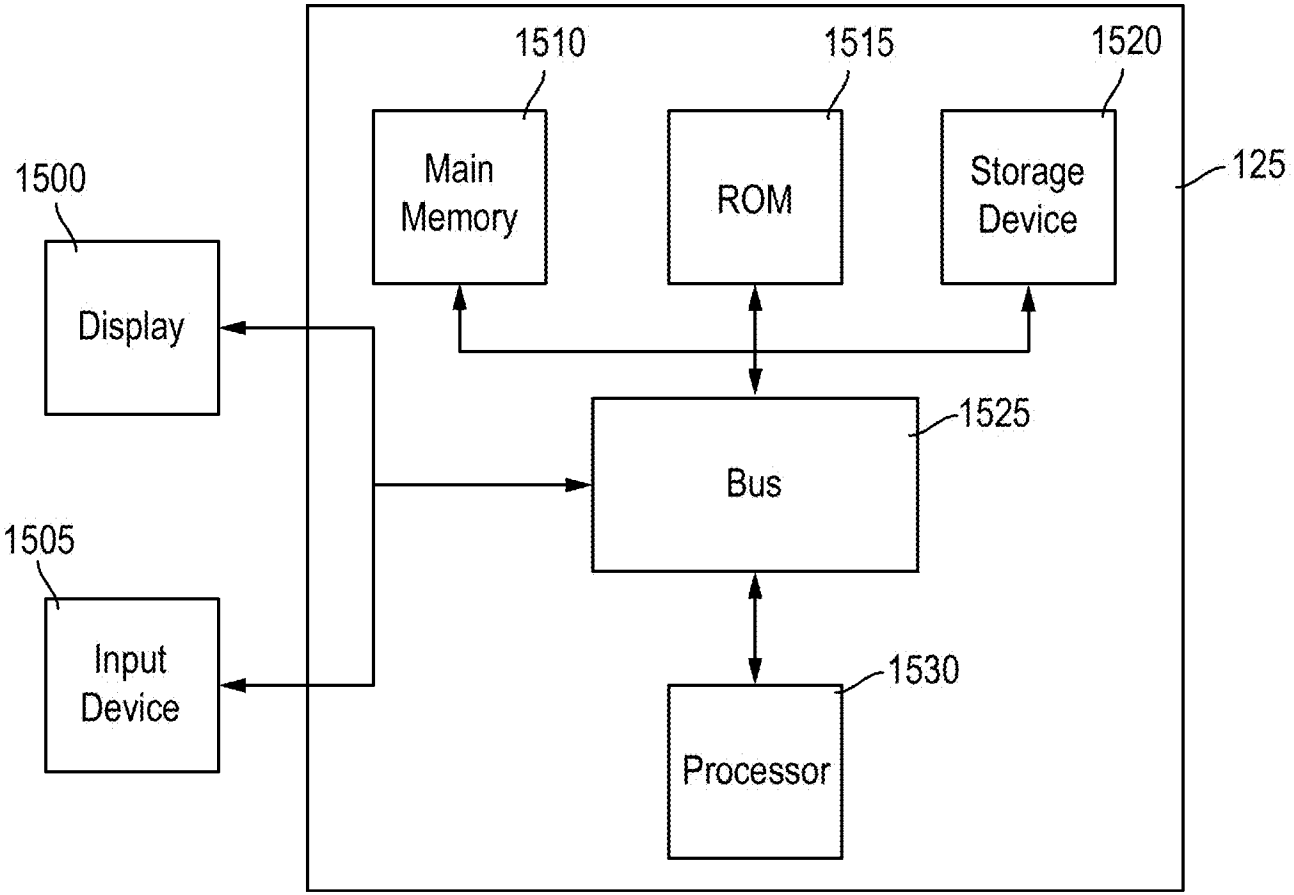
FIG. 15 is an example computing architecture of a computing system.

Referring now to FIG. 15, among others, is an example computing architecture of a computing system 125 is shown. The computing system 125 can include or be used to implement a data processing system or its components. The architecture of FIG. 15 can be used to implement the data processing system 360, a user device, the environmental dataset source 145, the middleware 140, or any other computing or processing system device, apparatus, or system. The computing system 125 can include at least one bus 1525 or other communication component for communicating information and at least one processor 1530 or processing circuit coupled to the bus 1525 for processing information. The computing system 125 can include one or more processors 1530 or processing circuits coupled to the bus 1525 for processing information. The computing system 125 can include at least one main memory 1510, such as a random access memory (RAM) or other dynamic storage device, coupled to the bus 1525 for storing information, and instructions to be executed by the processor 1530. The main memory 1510 can be used for storing information during execution of instructions by the processor 1530. The computing system 125 can further include at least one read only memory (ROM) 1515 or other static storage device coupled to the bus 1525 for storing static information and instructions for the processor 1530. A storage device 1520, such as a solid state device, magnetic disk or optical disk, can be coupled to the bus 1525 to persistently store information and instructions.

The computing system 125 can be coupled via the bus 1525 to a display 1500, such as a liquid crystal display, or active matrix display. The display 1500 can display information to a user. An input device 1505, such as a keyboard or voice interface can be coupled to the bus 1525 for communicating information and commands to the processor 1530. The input device 1505 can include a touch screen of the display 1500. The input device 1505 can include a cursor control, such as a mouse, a trackball, or cursor direction keys, for communicating direction information and command selections to the processor 1530 and for controlling cursor movement on the display 1500.

The processes, systems and methods described herein can be implemented by the computing system 125 in response to the processor 1530 executing an arrangement of instructions contained in main memory 1510. Such instructions can be read into main memory 1510 from another computer-readable medium, such as the storage device 1520. Execution of the arrangement of instructions contained in main memory 1510 causes the computing system 125 to perform the illustrative processes described herein. One or more processors in a multi-processing arrangement can be employed to execute the instructions contained in main memory 1510. Hard-wired circuitry can be used in place of or in combination with software instructions together with the systems and methods described herein. Systems and methods described herein are not limited to any specific combination of hardware circuitry and software.

Although an example computing system has been described in FIG. 15, the subject matter including the operations described in this specification can be implemented in other types of digital electronic circuitry, or in computer software, firmware, or hardware, including the structures disclosed in this specification and their structural equivalents, or in combinations of one or more of them.

Some of the description herein emphasizes the structural independence of the aspects of the system components or groupings of operations and responsibilities of these system components. Other groupings that execute similar overall operations are within the scope of the present application. Modules can be implemented in hardware or as computer instructions on a non-transient computer readable storage medium, and modules can be distributed across various hardware or computer based components.

The systems described above can provide multiple ones of any or each of those components and these components can be provided on either a standalone system or on multiple instantiations in a distributed system. In addition, the systems and methods described above can be provided as one or more computer-readable programs or executable instructions embodied on or in one or more articles of manufacture. The article of manufacture can be cloud storage, a hard disk, a CD-ROM, a flash memory card, a PROM, a RAM, a ROM, or a magnetic tape. In general, the computer-readable programs can be implemented in any programming language, such as LISP, PERL, C, C++, C#, PROLOG, Python, or in any byte code language such as JAVA. The software programs or executable instructions can be stored on or in one or more articles of manufacture as object code.

Example and non-limiting module implementation elements include sensors providing any value determined herein, sensors providing any value that is a precursor to a value determined herein, datalink or network hardware including communication chips, oscillating crystals, communication links, cables, twisted pair wiring, coaxial wiring, shielded wiring, transmitters, receivers, or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), or digital control elements.

The subject matter and the operations described in this specification can be implemented in digital electronic circuitry, or in computer software, firmware, or hardware, including the structures disclosed in this specification and their structural equivalents, or in combinations of one or more of them. The subject matter described in this specification can be implemented as one or more computer programs, e.g., one or more circuits of computer program instructions, encoded on one or more computer storage media for execution by, or to control the operation of, data processing apparatuses. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. While a computer storage medium is not a propagated signal, a computer storage medium can be a source or destination of computer program instructions encoded in an artificially generated propagated signal. The computer storage medium can also be, or be included in, one or more separate components or media (e.g., multiple CDs, disks, or other storage devices including cloud storage). The operations described in this specification can be implemented as operations performed by a data processing apparatus on data stored on one or more computer-readable storage devices or received from other sources.

The terms "computing device", "component" or "data processing apparatus" or the like encompass various apparatuses, devices, and machines for processing data, including by way of example a programmable processor, a computer, a system on a chip, or multiple ones, or combinations of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, app, script, or code) can be written in any form of programming language, including compiled or interpreted languages, declarative or procedural languages, and can be deployed in any form, including as a stand-alone program or as a module, component, subroutine, object, or other unit suitable for use in a computing environment. A computer program can correspond to a file in a file system. A computer program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatuses can also be implemented as, special purpose logic circuitry, e.g., an FPGA (field programmable gate array) or an ASIC (application specific integrated circuit). Devices suitable for storing computer program instructions and data can include non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The subject matter described herein can be implemented in a computing system that includes a back end component, e.g., as a data server, or that includes a middleware component, e.g., an application server, or that includes a front end component, e.g., a client computer having a graphical user interface or a web browser through which a user can interact with an implementation of the subject matter described in this specification, or a combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While operations are depicted in the drawings in a particular order, such operations are not required to be performed in the particular order shown or in sequential order, and all illustrated operations are not required to be performed. Actions described herein can be performed in a different order.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. ACTs, elements and features discussed in connection with one implementation are not intended to be excluded from a similar role in other implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any ACT or element being based on any information, act or element may include implementations where the act or element is based at least in part on any information, act, or element.

Any implementation disclosed herein may be combined with any other implementation or example, and references to "an implementation," "some implementations," "one implementation" or the like are not necessarily mutually exclusive and are intended to indicate that a particular feature, structure, or characteristic described in connection with the implementation may be included in at least one implementation or example. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

What is claimed is:

1. A system, comprising:

one or more processors to:

receive, via a communications network from an underwater vehicle in an aqueous medium and remote from the one or more processors, an indication of a location of the underwater vehicle;

predict, using the location of the underwater vehicle and a model constructed with at least one of historical ocean current data for the location or data associated with maritime topography of the location, movement of the underwater vehicle through the aqueous medium;

generate, according to the predicted movement, at least one control decision comprising a depth in the aqueous medium, a scheduled duration to submerge in the aqueous medium and travel at the depth, and a heading of the underwater vehicle; and transmit, via the communications network to the underwater vehicle, the at least one control decision to cause the underwater vehicle to submerge in the aqueous medium in accordance with the at least one control decision.

2. The system of claim 1, wherein the one or more processors are to:

determine, while the underwater vehicle is submerged, a simulated location of the underwater vehicle at a time stamp subsequent to the scheduled duration and responsive to the at least one control decision;

receive, via the communications network responsive to the underwater vehicle surfacing subsequent to the scheduled duration, a second location of the underwater vehicle;

predict, using the model, the simulated location and the second location, a second movement of the underwater vehicle through the aqueous medium;

generate, according to the second predicted movement, at least one second control decision comprising a second depth, a second duration, and a second heading; and transmit, via the communications network to the underwater vehicle, the at least one second control decision to cause the underwater vehicle to submerge in the aqueous medium in accordance with the at least one second control decision.

3. The system of claim 1, wherein the one or more processors are to:

receive, via the communications network responsive to the underwater vehicle surfacing subsequent to submerging in accordance with the at least one control decision, a second location of the underwater vehicle; and update the model according to the second location of the underwater vehicle.

4. The system of claim 3, wherein the one or more processors are to:

predict, using the updated model, second movement of the underwater vehicle through the aqueous medium;

generate at least one second control decision according to the predicted second movement; and transmit, via the communications network to the underwater vehicle, the at least one second control decision.

5. The system of claim 1, wherein the one or more processors are to:

generate, using a forecasted map of currents of the aqueous medium, a downscaled map that indicates downscaled currents of the aqueous medium; and predict the movement using the downscaled map.

6. The system of claim 1, wherein the underwater vehicle determines the location responsive to surfacing and according to a signal from a global positioning system.

7. The system of claim 1, wherein the one or more processors are to:

identify a mode of the underwater vehicle, wherein the mode comprises at least one of station keeping or navigation to a waypoint; and generate the at least one control decision according to the mode of the underwater vehicle.

8. The system of claim 1, wherein the one or more processors are to:

receive a plurality of locations from a plurality of gliders, the plurality of gliders comprising the underwater vehicle; and generate the at least one control decision for the underwater vehicle based at least in part on the plurality of locations to cause the underwater vehicle to maintain a predetermined distance relative to at least one of the plurality of gliders in the aqueous medium.

9. The system of claim 1, wherein the one or more processors are to:

receive, via the communications network, a plurality of locations from a plurality of gliders, the plurality of gliders comprising the underwater vehicle;

predict, using the plurality of locations, movements of the plurality of gliders through the aqueous medium;

generate, according to the plurality of predicted movements, a plurality of control decisions comprising a respective depth, a respective duration and a respective heading; and transmit, via the communications network to the plurality of gliders, the plurality of control decisions to cause the plurality of gliders to submerge in the aqueous medium in accordance with the plurality of control decisions.

10. The system of claim 9, wherein the one or more processors are to:

execute an optimization function on the predicted movements to determine the plurality of control decisions that reduce distances traveled by the plurality of gliders.

11. The system of claim 1, wherein the one or more processors are to:

provide, for display via a graphical user interface, a simulation comprising the predicted movement of the underwater vehicle and a second predicted movement of the underwater vehicle in accordance with the at least one control decision.

12. The system of claim 1, wherein the underwater vehicle comprises:

a buoyancy engine disposed within a fuselage of the underwater vehicle, the buoyancy engine configured to adjust a buoyancy and a center-of-gravity of the underwater vehicle in the aqueous medium to cause the underwater vehicle to submerge in the aqueous medium in accordance with the at least one control decision.

13. The system of claim 1, wherein the one or more processors are to:

receive, via the communications network from the underwater vehicle subsequent to the underwater vehicle submerging responsive to the at least one control decision, a second location from the underwater vehicle, wherein the underwater vehicle surfaces to provide the second location responsive to detection of an event and at a time stamp that is less than the scheduled duration; and receive data collected by a sensor of the underwater vehicle.

14. The system of claim 1, wherein the one or more processors are to:

generate the at least one control decision comprising data collection instructions; and transmit the at least one control decision to the underwater vehicle to cause the underwater vehicle to execute the data collection instructions.

15. A method, comprising:

receiving, by one or more processors, via a communication network from an underwater vehicle in an aqueous medium and remote from the one or more processors, an indication of a location of the underwater vehicle;

predicting, by the one or more processors, using the location of the underwater vehicle and a model constructed with at least one of historical ocean current data for the location or data associated with maritime topography of the location, movement of the underwater vehicle through the aqueous medium;

generating, by the one or more processors, according to the predicted movement, at least one control decision comprising a depth in the aqueous medium, a scheduled duration to submerge in the aqueous medium and travel at the depth, and a heading of the underwater vehicle; and transmitting, by the one or more processors to the underwater vehicle, the at least one control decision to cause the underwater vehicle to submerge in the aqueous medium in accordance with the at least one control decision.

16. The method of claim 15, comprising:

determining, by the one or more processors via the communication network, while the underwater vehicle is submerged, a simulated location of the underwater vehicle at a time stamp subsequent to the scheduled duration and responsive to the at least one control decision;

receiving, by the one or more processors via the communication network, responsive to the underwater vehicle surfacing subsequent to the scheduled duration, a second location of the underwater vehicle;

predicting, by the one or more processors using the model, the simulated location and the second location, a second movement of the underwater vehicle through the aqueous medium;

generating, by the one or more processors and according to the second predicted movement, at least one second control decision comprising a second depth, a second duration, and a second heading; and transmitting, by the one or more processors via the communication network to the underwater vehicle, the at least one second control decision to cause the underwater vehicle to submerge in the aqueous medium in accordance with the at least one second control decision.

17. The method of claim 15, comprising:

receiving, by the one or more processors via the communication network, responsive to the underwater vehicle surfacing subsequent to submerging in accordance with the at least one control decision, a second location of the underwater vehicle; and updating, by the one or more processors, the model according to the second location of the underwater vehicle.

18. The method of claim 17, comprising:

predicting, by the one or more processors using the updated model, second movement of the underwater vehicle through the aqueous medium;

generating, by the one or more processors, at least one second control decision according to the predicted second movement; and transmitting, by the one or more processors via the communication network to the underwater vehicle, the at least one second control decision.

19. An underwater vehicle, comprising:

a buoyancy engine disposed within a fuselage of the underwater vehicle, the buoyancy engine configured to adjust a buoyancy and a center-of-gravity of the underwater vehicle in an aqueous medium to cause the underwater vehicle to submerge in the aqueous medium;

a location sensor; and one or more processors to:

transmit, via a communication network to a data processing system remote from the underwater vehicle, an indication of a location of the underwater vehicle detected via the location sensor;

receive, via the communication network from the data processing system, control decisions comprising a depth and a scheduled duration to submerge in the aqueous medium and travel at the depth, the control decisions generated according to a predicted movement of the underwater vehicle predicted by the data processing system using the location of the underwater vehicle and a model constructed with at least one of historical ocean current data for the location or maritime topography of the location; and cause the buoyancy engine to submerge the underwater vehicle in the aqueous medium in accordance with the control decisions.

20. The underwater vehicle of claim 19, wherein the one or more processors are to:

detect, via a sensor of the underwater vehicle, a condition;

cause, responsive to the condition, the underwater vehicle to surface prior to expiration of a duration established in the control decisions; and transmit, via the communication network upon surfacing, a second location and data associated with the condition to the data processing system remote from the underwater vehicle.

* * * * *